US007508366B2

(12) United States Patent
Shiomi et al.

(10) Patent No.: US 7,508,366 B2
(45) Date of Patent: Mar. 24, 2009

(54) METHOD OF DRIVING A DISPLAY, DISPLAY, AND COMPUTER PROGRAM FOR THE SAME

(75) Inventors: Makoto Shiomi, Tenri (JP); Kazunari Tomizawa, Kyoto (JP); Koichi Miyachi, Kyoto (JP); Mitsuhiro Shigeta, Uji (JP)

(73) Assignee: Sharp Kabushiki Kaisha, Osaka (JP)

( * ) Notice: Subject to any disclaimer, the term of this patent is extended or adjusted under 35 U.S.C. 154(b) by 943 days.

(21) Appl. No.: 10/679,477

(22) Filed: Oct. 7, 2003

(65) Prior Publication Data

US 2004/0135777 A1 Jul. 15, 2004

(30) Foreign Application Priority Data

Oct. 7, 2002 (JP) ..... 2002-294172

(51) Int. Cl.
*G09G 3/36* (2006.01)

(52) U.S. Cl. ..... 345/87; 345/88

(58) Field of Classification Search ..... 345/691, 345/692, 693, 694–695, 87–100, 204
See application file for complete search history.

(56) References Cited

U.S. PATENT DOCUMENTS 6,414,669 B1 * 7/2002 Masazumi ..... 345/98
7,145,581 B2 * 12/2006 Willis ..... 345/691
7,277,076 B2 * 10/2007 Shiomi et al. ..... 345/89
2002/0033789 A1 3/2002 Miyata et al.
2002/0044115 A1 4/2002 Jinda et al.
2004/0135800 A1 * 7/2004 Shiomi et al. ..... 345/691

FOREIGN PATENT DOCUMENTS

JP 2650479 5/1997

* cited by examiner

*Primary Examiner*—Nitin Patel
(74) *Attorney, Agent, or Firm*—Harness, Dickey & Pierce, PLC

(57) ABSTRACT

A display has a circuit for comparing video data for a first or current frame with video data for a second or desired frame. A processing section makes an instruction for a process to take place if certain conditions are met. In response to the instruction for a process, a signal generation circuit outputs a signal which reduces a degree of modulation or variation by which tone transition is facilitated relatively to a case where pixels are driven on the basis of data output from an ordinary processing section. Thus, by modulating or varying a drive signal to a degree suitable for a case where tone transition is sufficient, a display capable of improving display quality even in a situation where the display is not capable of being driven suitably, can be realized using circuitry of a relatively small scale.

130 Claims, 11 Drawing Sheets

METHOD OF DRIVING A DISPLAY, DISPLAY, AND COMPUTER PROGRAM FOR THE SAME

The present application hereby claims priority under 35 U.S.C. §119 on Japanese patent application number 294172/2002 filed Oct. 7, 2002, the entire contents of which are hereby incorporated herein by reference.

FIELD OF THE INVENTION

The present invention generally relates to a method of driving a display, a display, a drive signal processor, a computer program for the same, and a computer-readable storage medium with the program recorded thereon.

BACKGROUND OF THE INVENTION

Liquid crystal displays, operational on relatively low electric power, are found in a wide range of applications from mobile to stationary devices. In comparison to the cathode-ray tube (CRT), the liquid crystal display is slow to respond, hence to change tone, and may fail to respond completely within a rewrite time (16.7 msec) corresponding to an ordinary frame frequency (60 Hz), i.e., frame period. US 2002/0044115 A1 published on Apr. 18, 2002, a counterpart of Japanese Published Unexamined Patent Application or Tokukai 2002-116743, suggests a method addressing this issue which modulates drive signals for quick transition from the current tone to the desired tone.

For example, suppose that the tone transition from the current frame FR(k−1) to the desired frame FR(k) requires a "rise" drive. If so, a higher voltage than that represented by the video data D(i, j, k) for the desired frame FR(k) is applied to a pixel, so as to facilitate the transition from the current tone to the desired tone.

In tone transition, the application of such a voltage increases the brightness level of the pixel more abruptly and takes less time to raise it to the proximity of the brightness level in accordance with the video data D(i, j, k) for the desired frame FR(k) than the application of an exact voltage represented by the video data D(i, j, k) for the desired frame FR(k). Thus, the liquid crystal display will have a fast response speed despite the slow response speed of the liquid crystal.

However, suitable tone transition facilitation may become impossible for a desired frame if the tone transition is facilitated presuming that transition is sufficiently performed from the current tone to the desired tone, despite the fact to the contrary, i.e., a targeted brightness level is actually not reached in the transition from the current tone to the desired tone despite such driving that the tone transition is facilitated to overcome insufficient liquid crystal response speed.

For example, when the liquid crystal is driven so that the transition from the previous tone through the current tone to the desired tone (transition from the previous tone to the current tone and transition from the current tone to the desired tone) is a "decay" followed by a "rise" as indicated in a solid line in FIG. 12, if the liquid crystal response speed is fast enough, sufficient tone transition occurs as indicated by a dash-dot line in the figure. In some cases, however, the transition from the previous tone to the current tone is so insufficient that the brightness level does not sufficiently drop at the end of the current frame FR(k−1) as indicated by a broken line in the figure. If the pixel is driven in the desired frame FR(k) with enhanced tone transition similarly to the case of sufficient tone transition in such cases, the tone transition is enhanced too much and causes excess brightness.

When the liquid crystal is driven so that the transition from the previous tone through the current tone to the desired tone is a "rise" followed by a "decay" as indicated by a solid line in FIG. 13, if the liquid crystal response speed is fast enough, sufficient tone transition occurs as indicated by a dash-dot line in the figure. In some cases, however, the transition from the previous tone to the current tone is so insufficient that the brightness level does not sufficiently "rise" at the end of the current frame FR(k−1) as indicated by a broken line in the figure. If the pixel is driven in the desired frame FR(k) with enhanced tone transition similarly to the case of sufficient tone transition in such cases, the tone transition is enhanced too much and causes inadequate brightness.

When the liquid crystal is driven so that the transition from the previous tone through to the desired tone is a "decay" followed by another "decay" as in indicated by a solid line in FIG. 14, if the liquid crystal response speed is fast enough, sufficient tone transition occurs as indicated by a dash-dot line in the figure. In some cases, however, the transition from the previous tone to the current tone is so insufficient that the brightness level does not sufficiently drop at the end of the current frame FR(k−1) as indicated by a broken line in the figure. In these cases, the liquid crystal response speed in the desired frame FR(k) tends to slow down.

Similarly, when the liquid crystal is driven so that the transition from the previous tone through to the desired tone is a "rise" followed by another "rise" as indicated by a solid line in FIG. 15, if the liquid crystal response speed is fast enough, sufficient tone transition occurs as indicated by a dash-dot line in the figure. In some cases, however, the transition from the previous tone to the current tone is so insufficient that the brightness level does not sufficiently "rise" at the end of the current frame FR(k−1) as indicated by a broken line in the figure. In these cases, the liquid crystal response speed in the desired frame FR(k) tends to slow down.

Addressing the same problems, Japanese Patent No. 2650479 (published on Sep. 3, 1997) corrects signal data applied to the liquid crystal throughout the two or more fields after the first signal data. The scheme requires that video data for multiple fields be stored, and will likely add to the circuit dimensions.

As detailed in the foregoing, according to US 2002/0044115 A1, the display element does not have a sufficient response speed. If tone transition is enhanced similarly to the case of sufficient tone transition despite the actual fact that tone transition is insufficient, the tone transition is enhanced too much and may degrade the display quality of the display.

Meanwhile, Japanese Patent No. 2650479 requires that video data for multiple fields be stored, and will likely add to the circuit dimensions. This is especially true when it is considered that many displays are required to increase its number of pixels and tones to produce a more natural and smooth image.

SUMMARY OF THE INVENTION

An embodiment of the present invention has an objective of providing a method of driving a display by which a display with possible higher display quality is realized using circuitry of a relatively small scale, even in a situation where the display is not suitably driven if the drive signal is modulated to such an extent as to be suitable in the case of sufficient tone transition. Further objects of further embodiments include providing a display; a drive signal processor; a computer program for the same; and a computer-readable storage medium with the program recorded thereon.

A method of driving a display of an embodiment of the present invention, to achieve an objective, may include:

storing data corresponding to a drive signal input at a first time;

modulating a drive signal input at a second time, subsequent to the first time, based upon the stored data so as to facilitate a tone transition from the first time to the second time;

comparing data corresponding to the drive signal input at the first time and data input at a time previous to the first time, wherein a degree of the modulation is adjustable prior to modulating, with reference to the result of the comparison.

According to the arrangement, a result of the comparison of the data for the previous time with the data for the first or current time is stored as information associated with a tone transition from the previous time to the current time. Further, the degree of modulation in the modulation step for the desired or second time is adjusted with reference to the result of the comparison.

Therefore, the arrangement has an effect that a display capable of adjusting the degree of the modulation to a degree in accordance with the situation, even when a normal process cannot suitably drive the display. As such, improved display quality can be realized using circuitry of a relatively small scale.

A method of driving a display of an embodiment of the present invention, to achieve an objective, may include:

determining a display drive signal based on desired drive signal data and current corresponding drive signal data; and driving the display with a selected one of the determined display drive signal and a variation of the determined display drive signal, selected based upon at least a previous corresponding drive signal data and the current drive signal data. Further, the current corresponding drive signal data may include data from a drive signal input at a first time, the desired drive signal data may include data from a drive signal input at a second time, subsequent to the first time, and the previous corresponding drive signal data may include data from a drive signal input at a time previous to the first time.

A display in accordance with an embodiment of the present invention, to achieve an objective, may include:

a first storage for storing data corresponding to a drive signal input at a first time;

a modulator for modulating a drive signal input at a second time, subsequent to the first time, based upon the stored data so as to facilitate a tone transition from the first time to the second time;

a second storage for storing a result of a comparison of the stored data corresponding to the drive signal input at the first time and data input at a time previous to the first time; and an adjuster for adjusting a degree of the modulating by the modulator with reference to the result of the comparison stored in the second storage.

The display having the arrangement can be driven by the aforementioned method of driving a display. Therefore, by modulating a drive signal to an ordinary degree similarly to the method of driving a display, the arrangement has an effect that a display capable of adjusting the degree of the modulation to a degree in accordance with the situation, even when a normal process cannot suitably drive the display. Further, improved display quality can be realized using circuitry of a relatively small scale.

A drive signal processor in accordance with an embodiment of the present invention, to achieve an objective, may be a drive signal processor for processing a display drive signal, and may include:

memory means for storing data of a drive signal input at a first time;

modulation means for modulating a drive signal input at a second time, subsequent to the first time, based upon the stored data so as to facilitate a tone transition from the first time to the second time;

comparison result memory means for storing a result of a comparison of the stored data corresponding to the drive signal input at the first time and data input at a time previous to the first time; and adjusting means for adjusting a degree of the modulating by the modulation means with reference to the result of the comparison stored in the comparison result memory means.

The drive signal processor having the arrangement is capable of processing a drive signal with which the aforementioned method of driving a display can be implemented. Therefore, by modulating a drive signal to an ordinary degree similarly to the method of driving a display, the arrangement has an effect of a display capable of adjusting the degree of the modulation to a degree in accordance with the situation, even when the display cannot suitably drive. Further, improved display quality can be realized using circuitry of a relatively small scale.

A program in accordance with an embodiment of the present invention is a program causing a computer to execute the aforementioned method steps of an embodiment of the invention.

Therefore, when the program is run on a computer, the computer can drive the display by the aforementioned drive method. As a result, by modulating a drive signal to an ordinary degree, similarly to the method of driving a display, the arrangement has an effect that a display capable of adjusting the degree of the modulation to a degree in accordance with the situation, even when the display cannot suitably drive. Further, improved display quality can be realized using circuitry of a relatively small scale.

A storage medium in accordance with an embodiment of the present invention is a computer-readable storage medium on which the program is recorded.

Therefore, when the program stored on the storage medium is loaded and run on a computer, the computer can drive the display by the aforementioned drive method. As a result, by modulating a drive signal to an ordinary degree similarly to the method of driving a display, the arrangement has an effect that a display capable of adjusting the degree of the modulation to a degree in accordance with the situation, even when the display cannot suitably drive. Further, improved display quality can be realized using circuitry of a relatively small scale.

Additional objects, advantages and novel features of embodiments of the invention will be set forth in part in the exemplary description which follows, and in part will become apparent to those skilled in the art upon examination of the following or may be learned by practice of the invention.

BRIEF DESCRIPTION OF THE DRAWINGS

The present invention will become more fully understood from the detailed description of preferred embodiments given hereinbelow and the accompanying drawings which are given by way of illustration only, and thus are not limitative of the present invention, and wherein.

DESCRIPTION OF THE EMBODIMENTS

Embodiment 1

The following will describe an embodiment in accordance with the present invention in reference to FIG. 1 through FIG. 6. An image display (display) 1 of the present embodiment varies, modulates for example, a signal driving the pixel for a desired tone so as to facilitate transition of a pixel from the previous tone to the desired tone. Thereby the response speed of a display element is improved. Further, it is capable of preventing display qualities caused by unsuitable modulation from happening using relatively simple circuitry.

Figure 2:
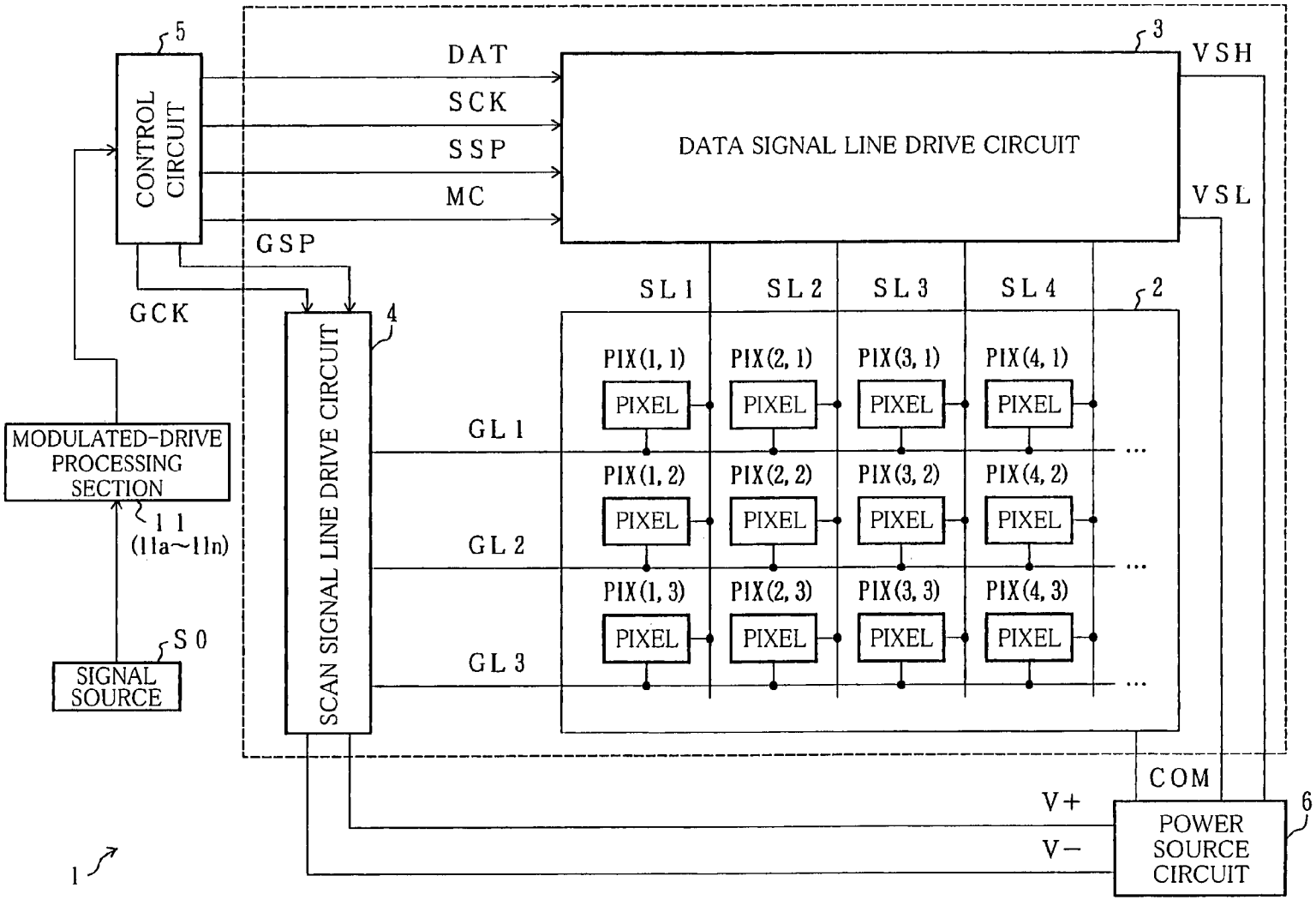
FIG. 2 is a block diagram of a major part of the arrangement of an entire image display with the modulated-drive processing section.

Referring to FIG. 2, the image display 1 includes a pixel array 2 of pixels PIX(1, 1) to PIX(n, m) arranged in a matrix, a data signal line drive circuit 3 which drives the data signal lines SL1-SLn in the pixel array 2, a scan signal line drive circuit 4 which drives the scan signal lines GL1-GLm in the pixel array 2, a control circuit 5 which supplies a control signal to the drive circuits 3, 4, and a modulated-drive processing section (drive signal processor) 11 which varies or modulates an incoming video signal to produce a varied or modulated video signal output to the control circuit 5 to facilitate tone transition. These circuits are powered by a power source circuit 6, for example.

The following will briefly describe the arrangement and operation of the entire image display 1, which description will be accompanied by details of the arrangement of the modulated-drive processing section 11. For convenience of description, the members will be assigned a number or letter (s) indicating their position as a reference symbol (e.g., the i-th data signal line is assigned SLi) only when their position needs to be specified. Otherwise, they will be referred to with those position-indicating numbers and letters omitted.

The pixel array 2 includes multiple (n in this case) data signal lines SL1-SLn and multiple (m in this case) scan signal lines GL1-GLm which cross the respective data signal lines SL1-SLn. A pixel PIX(i, j) is provided for every combination of the data signal line SLi and the scan signal line GLj where i is any integral from 1 to n, and j is any integral from 1 to m.

In the present embodiment, the pixel PIX(i, j) is located so as to be surrounded by a pair of adjacent data signal lines SL(i−1), SLi and a pair of adjacent scan signal lines GL(j−1), GLj.

Figure 3:
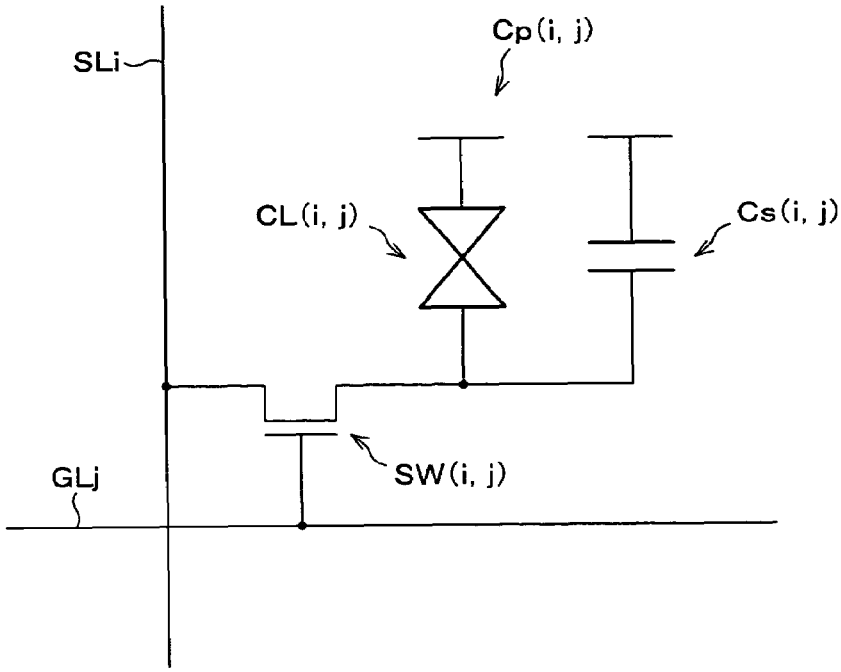
FIG. 3 is a circuit diagram of an example arrangement of a pixel in the image display.

For descriptive purposes, an example is taken where the image display 1 is a liquid crystal display. Referring to FIG. 3, the pixel PIX(i, j)includes, for example, a field effect transistor SW(i, j) as a switching element with its gate connected to the scan signal line GLj and drain connected to the data signal line SLi and a pixel capacitance Cp(i, j) with one of its two electrodes connected to the source of the field effect transistor SW(i, j). The other end of the pixel capacitance Cp(i, j) is connected to a common electrode line shared by all the pixels PIX. The pixel capacitance Cp(i, j) is formed by a liquid crystal capacitance CL(i, j) and an auxiliary capacitance Cs(i, j) which is added where necessary.

Selecting the scan signal line GLj in the pixel PIX(i, j) turns on the field effect transistor SW(i, j), passing the voltage on the data signal line SLi to the pixel capacitance Cp(i, j). As the select period ends for the scan signal line GLj, the field effect transistor SW(i, j) is turned off, enabling the pixel capacitance Cp(i, j) to store a voltage immediately before the field effect transistor SW(i, j) is turned off. Under these conditions, the transmittance and reflectance of the liquid crystal vary depending on the voltage applied to the liquid crystal capacitance CL(i, j). Therefore, the display state of the pixel PIX(i, j) is alterable according to video data D by selecting the scan signal line GLj and applying a voltage to the data signal line SLi in accordance with the video data D for the pixel PIX(i, j).

The liquid crystal display of the present embodiment employs as the liquid crystal cell a liquid crystal cell of vertical alignment mode: i.e., liquid crystal molecules align substantially vertical to the substrate when no voltage is being applied and slant relative to the vertical alignment in accordance with the voltage applied to the liquid crystal capacitance CL(i, j) in the pixel PIX(i, j). The liquid crystal cell is used in normally black mode (a black display is produced when no voltage is being applied).

In the arrangement, as shown in FIG. 2, the scan signal line drive circuit 4 outputs a signal (for example, a voltage signal)

indicating a select/non-select period to the scan signal lines GL1-GLm. The scan signal line drive circuit 4 changes scan signal lines GL to which the signal indicating a select period is to be supplied, based on, for example, timing signals such as a clock signal GCK and a start pulse signal GSP fed from the control circuit 5. Thus, a scan signal line is selected sequentially from the scan signal lines GL1-GLm at predetermined timings.

The data signal line drive circuit 3 acquires a video signal DAT by sampling at predetermined timings the video data D fed in a time-sharing manner to the pixels PIX and produces signals in accordance with the video data D for output through the data signal lines SL1-SLn to the respective pixels PIX(l, j) to PIX(n, j) associated with the scan signal line GLj currently selected by the scan signal line drive circuit 4.

The data signal line drive circuit 3 determines the sampling and signal output timings on the basis of timing signals, such as the clock signal SCK and the start pulse signal SSP, supplied from the control circuit 6.

The pixels PIX(l, j) to PIX(n, j) determine the brightness of their own by adjusting the brightness, transmittance, and other factors in radiation in accordance with the signal outputted to the data signal lines SL1-SLn respectively while the associated scan signal line GLj is being selected.

Here, because the scan signal line drive circuit 4 selects a scan signal line sequentially from the scan signal lines GL1-GLm, the brightness of each pixel PIX(1, 1) to PIX(n, m) in the pixel array 2 is set as indicated by the video data D supplied to that pixel, thereby updating the image display produced by the pixel array 2.

In the image display 1, the video signal DAT supplied from a video signal source SO to the modulated-drive processing section 11 may be transferred frame by frame (screen by screen) or field by field after each frame is divided into multiple fields. The following description will be based on, as an example, a field-by-field transfer.

Specifically, in transferring the video signal DAT through the signal line SL to the modulated-drive processing section 11 in the image display 1, the signal source SO transfers video data for each field in a time-sharing manner by, for example, transferring a complete set of video data for a field before proceeding to the transfer of video data for a next field.

Besides, a field consists of multiple horizontal lines. For the signal lines SL, video data for the horizontal lines is transferred by in a time-sharing manner, for example, first transferring all video data D(l, j, k) to D(n, j, k) for a horizontal line and then transferring video data for a next horizontal line.

Further, the signal source S0 serially drives the signal lines SL in transferring video data D(l, j, k) to D(n, j, k) for one horizontal line so that the video data is transferred in a time-sharing manner in a predetermined sequence.

As will be detailed later, to facilitate tone transition in driving the pixels PIX(i, j), the control circuit 5 of the present embodiment controls the data signal line drive circuit 3 and the scan signal line drive circuit 4 so that the data signal line drive circuit 3 can apply voltage to the pixels PIX(i, j) more than once in a single frame. The modulated-drive processing section 11 of the present embodiment divides a frame into multiple periods T1, T2, and in each of the periods T1, T2, provides to the control circuit 5 an output signal indicative of a voltage level which the data signal line drive circuit 3 should apply to the pixels PIX(i, j).

Here, the modulated-drive processing section 11 of the present embodiment performs a specialized process to restrain tone transition facilitation when the transition from the previous tone to the current tone is a "decay", that is, V(i, j, k−2)>V(i, j, k−1), and the transition from the current tone to the desired tone is a "rise", that is, V(i, j, k−1)<V(i, j, k), relative to that when the transition occurs otherwise (normal process), where D(i, j, k−2), D(i, j, k−1), and D(i, j, k) are the video data fed to a pixel PIX(i, j) in the previous frame FR(k−2), the current frame FR(k−1) respectively, and the desired frame FR(k), and V(i, j, k−2), V(i, j, k−1), and V(i, j, k) are the respective voltage levels applied to the pixels PIX(i, j) corresponding to the video data D.

Figure 1:
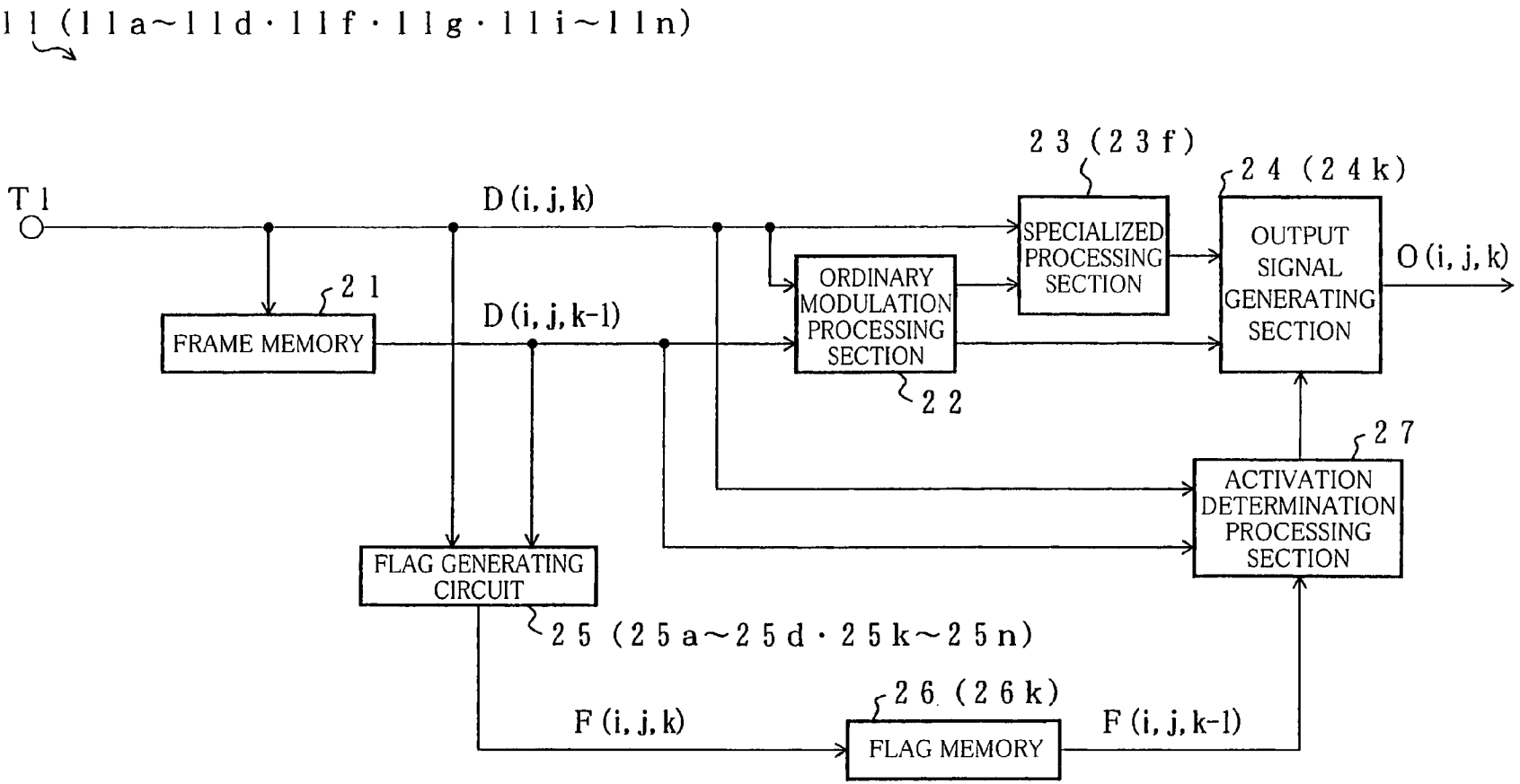
FIG. 1, illustrating an embodiment in accordance with the present invention, is a block diagram of a major part of the arrangement of a modulated-drive processing section.

Specifically, referring to FIG. 1, the modulated-drive processing section 11 includes: a frame memory 21 storing video data D(i, j, k) for one frame which is fed from the input terminal T1; an ordinary modulation processing section 22 (processor) for modulating or varying the video data D(i, j, k) for the desired frame FR(k) for data output on the basis of video data D(i, j, k) for the desired frame FR(k) which is fed from the input terminal T1 and video data D(i, j, k−1) for the current frame FR(k−1) which is read from the frame memory 21, both the video data D(i, j, k) and the video data D(i, j, k−1) being supplied to the same pixel PIX(i, j), so as to facilitate tone transition from the current frame FR(k−1) to the desired frame FR(k); a specialized processing section 23 (second processor) for outputting a variation of data than the ordinary modulation processing section 22 (such as less modulated data for example); and an output signal generating section 24 (selector) for generating or selecting an output signal O(i, j, k) on the basis of data from the ordinary modulation processing section 22 in a normal process and on the basis of data from the specialized processing section 23 in a specialized process. It should be noted that the specialized processor 23 can be a simple circuit.

In the present embodiment, the specialized processing section 23 outputs, as the less modulated data for example, the mean value of an output from the ordinary modulation processing section 22 and the video data D(i, j, k) for the desired frame FR(k).

The ordinary modulation processing section 22 of the present embodiment is embodied as, for example, an LUT (Look Up Table). Specifically, the LUT stores all output data for every input combination of the video data D(i, j, k−1) for the current frame FR(k−1) and the video data D(i, j, k) for the desired frame FR(k). The LUT thereby makes it possible to realize, using small-scale circuitry, the ordinary modulation processing section 22 which is capable of producing a highly precise data output in accordance with the combination of the input video data D(i, j, k−1) and D(i, j, k) with no problems even when small-scale circuitry cannot evaluate an expression which approximates data corresponding to the combinations to high precision.

Further, the modulated-drive processing section 11 may include: a flag generating circuit 25 for, through comparison of the video data D(i, j, k−1) and D(i, j, k), generating a flag F(i, j, k) for the desired frame FR(k) which indicates a "true" when transition from the current tone to the desired tone is a "decay", that is, V(i, j, k−1)>V(i, j, k) where V(i, j, k−1) is the voltage level for the current frame FR(k−1) and V(i, j, k) is the voltage level for the desired frame FR(k) and "false" in other cases; a flag memory 26 for storing the generated flag F(i, j, k) for one frame; and an activation determination processing section 27 for instructing the output signal generating circuit 24 to perform a specialized process when the flag F(i, j, k−1) stored in the flag memory 26 in the current frame FR(k−1) is true (in this case, a "decay") and transition from the current tone to the desired tone is a "rise" and perform a normal process under different conditions.

In the present embodiment, the activation determination processing section 27 determines, on the basis of the video data D(i, j, k−1) stored in the frame memory 21 for the current frame FR(k−1) and the video data D(i, j, k) for the desired frame FR(k), whether the transition from the current tone to the desired tone is a "rise".

In the arrangement, in a frame FR(k), the flag generating circuit 25 compares the video data D(i, j, k−1) for the current frame FR(k−1) with the video data D(i, j, k) for the desired frame FR(k), both being read from the frame memory 21, and stores the comparison result as a flag F(i, j, k), for example, in the flag memory 26. The flag F(i, j, k) is fed to the activation determination processing section 27 in the next frame FR(k+1) together with the video data D(i, j, k+1) for the next frame FR(k+1) and the video data D(i, j, k) read from the frame memory 21 in the next frame FR(k+1).

Therefore, in each frame FR(k), the activation determination processing section 27 receives, together with the video data D(i, j, k) for a desired or second frame FR(k), the video data D(i, j, k−1) for a current or first frame FR(k−1) and a flag F(i, j, k−1) indicating the result of comparison between the video data D(i, j, k−2) for a previous frame FR(k−2) and the video data D(i, j, k−1) for the current frame FR(k−1) from the frame memory 21 and the flag memory 26. It then determines whether to perform a normal process or a specialized process on the basis of the received flag and data and provides an indication to the output signal generating section 24 to make an appropriate selection.

Here, if transition from the current tone to the desired tone is a "decay", that is, the input video data D(i, j, k) for the desired frame FR(k) indicates that a lower voltage than the video data D(i, j, k−1) for the current frame FR(k−1) should be applied to the pixel PIX(i, j), the activation determination processing section 27 makes an instruction for a normal process, no matter what the transition from the previous tone to the current tone is.

Figure 4:
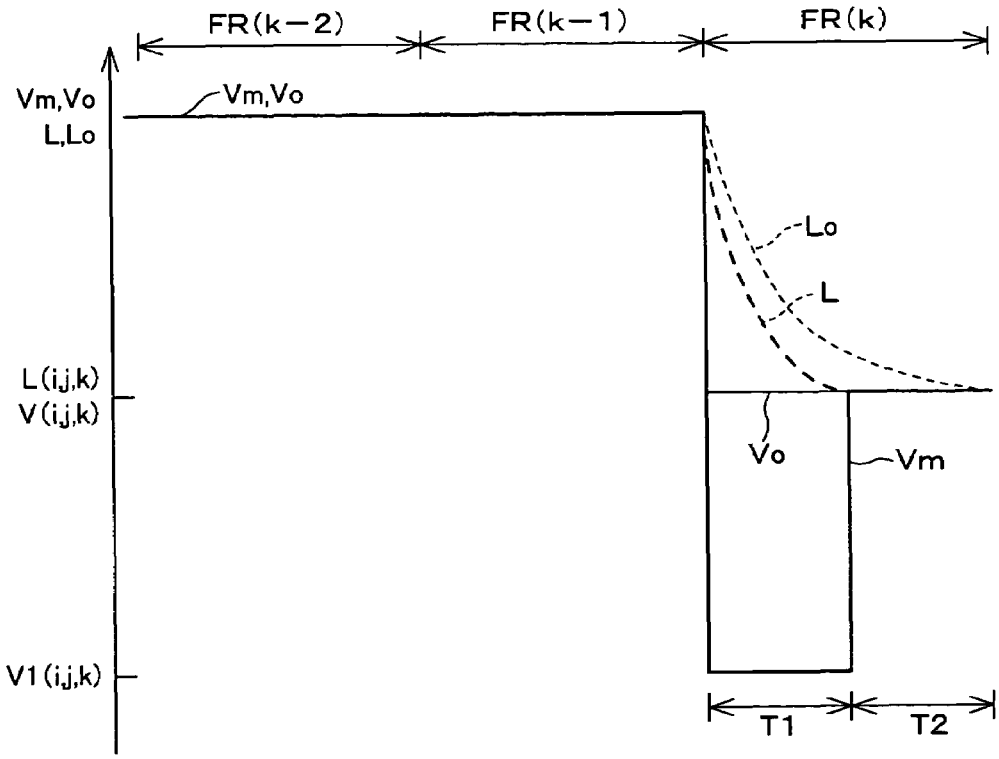
FIG. 4, illustrating operation of the modulated-drive processing section, is a timing chart showing a pixel-applied voltage and brightness levels in an ordinary process of a ""decay"" tone transition.

Under these circumstances, as indicated by a bold solid line in FIG. 4, the modulated-drive processing section 11 outputs such an output signal O1(i, j, k) as to apply a voltage V1(i, j, k) lower than the voltage level V(i, j, k) indicated by the video data D(i, j, k) to the pixel PIX(i, j) in a first one, T1, of multiple periods into which is divided a vertical synchronization period, and outputs such an output signal O2(i, j, k) as to apply the voltage level V(i, j, k) to the pixel PIX(i, j) in the current period T2.

Consequently, as indicated by a bold broken line in FIG. 4, the brightness level L of the pixel PIX(i, j), in the period T1, decreases more rapidly and reaches the proximity of the brightness level in accordance with the voltage level V(i, j, k) in a shorter time than the brightness level (identified as Lo in FIG. 4 in a thin broken line) when the voltage waveform identified as Vo in FIG. 4 is applied, that is, when the exact voltage level V(i, j, k) indicated by the video data D(i, j, k) for the desired frame is applied.

Here, since the transition from the current tone to the desired tone in the example in FIG. 4 is a "decay", even if the response speed of the pixel PIX(i, j) is slow, the pixel PIX(i, j) only does not achieve the brightness level indicated by the video data D(i, j, k) for the desired frame FR(k) at the end of the desired frame FR(k); as in a "decay" followed by a "rise" (detailed later), no shortcoming occurs where the pixel PIX(i, j) exceeds a desired brightness level L(i, j, k), becomes excessively bright, and shows devastatingly degraded display quality.

The output signal generating circuit 24 thus facilitates tone transition from the current frame FR(k−1) to the desired frame FR(k) on the basis of data from the ordinary modulation processing section 22; the brightness rapidly changes to the level indicated by the video data D(i, j, k) for the desired frame FR(k), while retaining good display quality of the pixel PIX(i, j).

The voltage level V1(i, j, k) applied to during the period T1 is lower than the original voltage level V(i, j, k). This results in that applying that level of voltage continuously may therefore give rise to the pixel PIX(i, j) failing to achieve the brightness level L(i, j, k) indicated by the video data D(i, j, k) for the desired frame. However, in the present embodiment, since the voltage level V(i, j, k) is applied to the pixel PIX(i, j) in the current period T2, the brightness level does not change excessively and fall below the brightness level L(i, j, k), but reaches the value L(i, j, k) smoothly.

Besides, even if the transition from the current tone to the desired tone is a "rise", that is, the input video data D(i, j, k) for the desired frame indicates that a higher voltage than the video data D(i, j, k−1) for the current frame should be applied to the pixel PIX(i, j), the activation determination processing section 27 makes an instruction for a normal process unless the transition from the previous tone to the current tone is a "decay". When this is the event, as indicated by a bold solid line in FIG. 5, the modulated-drive processing section 11 outputs such an output signal O1(i, j, k) as to apply a voltage V1(i, j, k) higher than the voltage level V(i, j, k) indicated by the video data D(i, j, k) to the pixel PIX(i, j) in the first one, T1, of the periods into which is divided a vertical synchronization period, and outputs such an output signal O2(i, j, k) as to apply the voltage level V(i, j, k) to the pixel PIX(i, j) in the current period T2.

Figure 5:
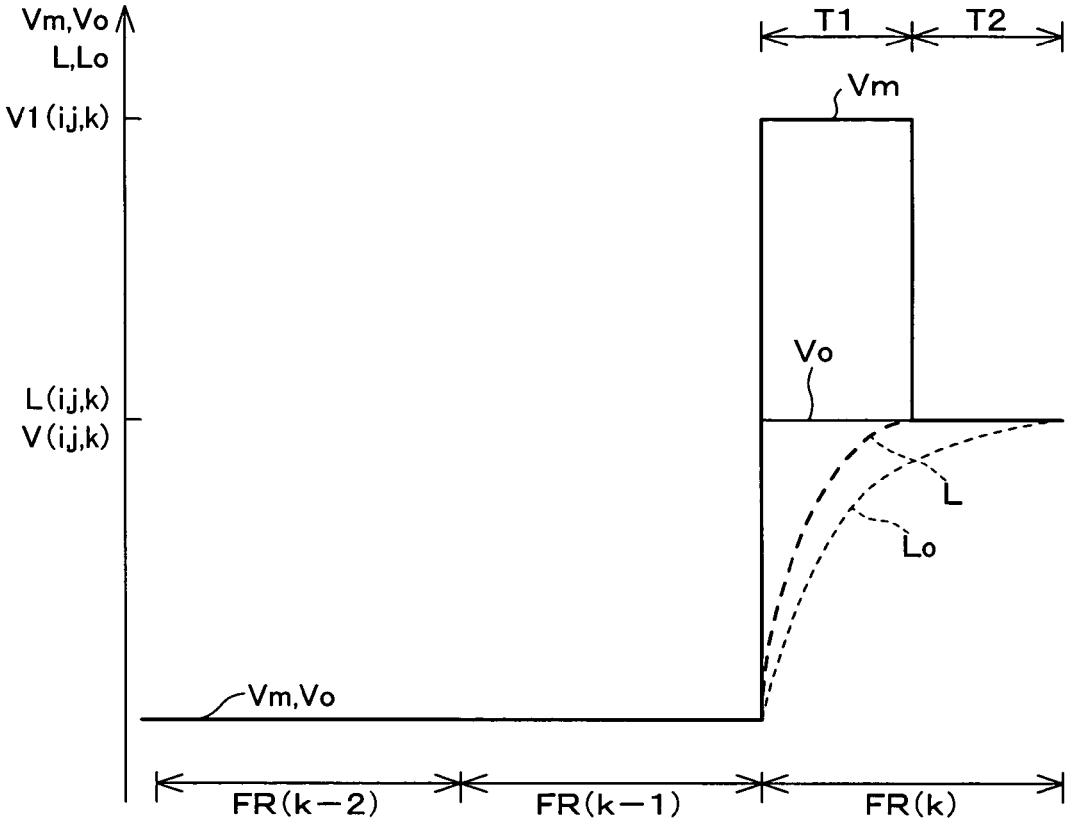
FIG. 5, illustrating operation of the modulated-drive processing section, is a timing chart showing a pixel-applied voltage and brightness levels in an ordinary process of a ""rise"" tone transition.
Figure 6:
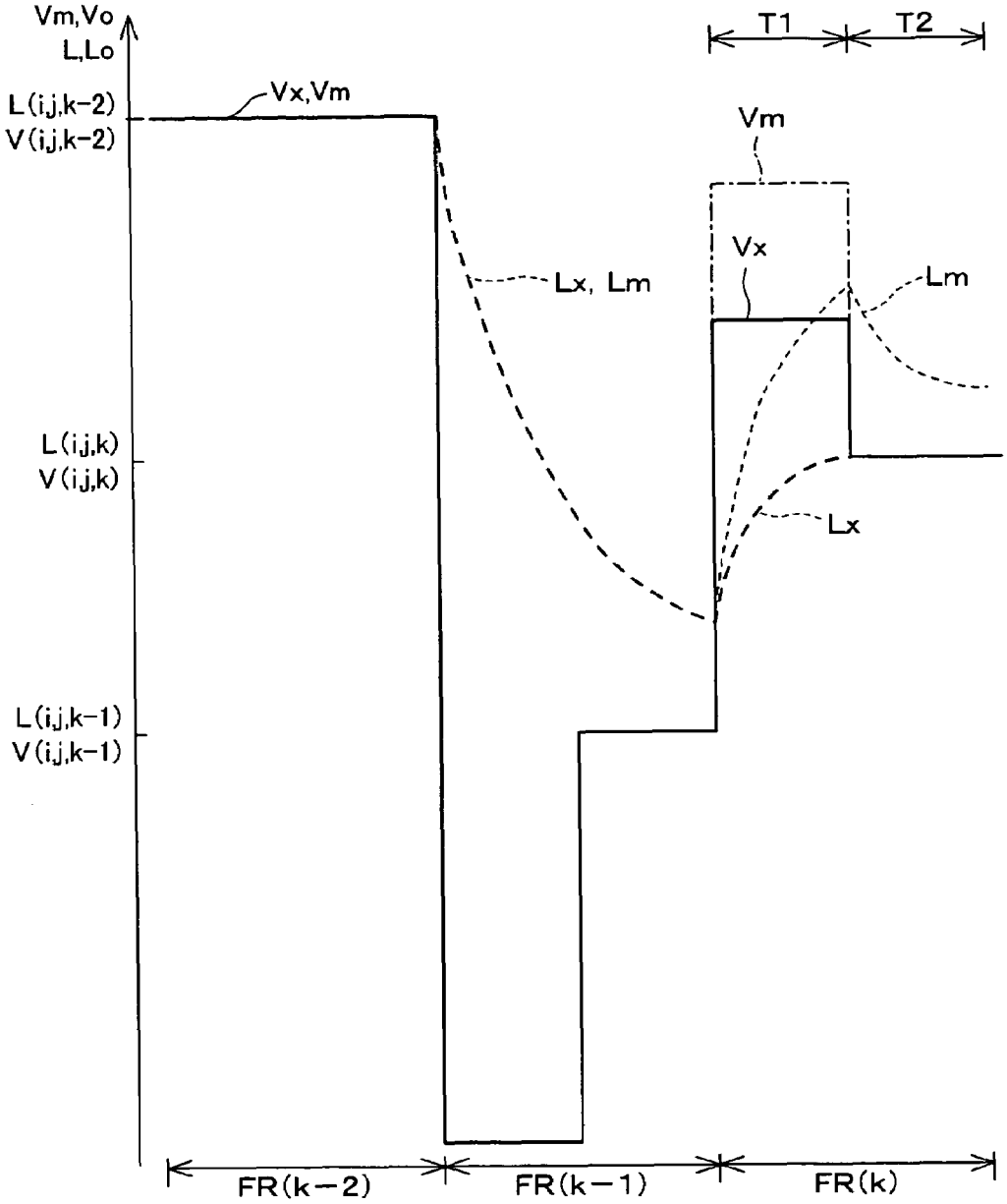
FIG. 6, illustrating operation of the modulated-drive processing section, is a timing chart showing a pixel-applied voltage and brightness levels in a specialized process.

Consequently, as indicated by a bold broken line in FIG. 5, the brightness level L of the pixel PIX(i, j), in the period T1, increases more rapidly and reaches the proximity of the brightness level in accordance with the voltage level V(i, j, k) in a shorter time than the brightness level (identified as Lo in FIG. 5 in a thin broken line) when the voltage waveform identified as Vo in FIG. 5 is applied, that is, when the exact voltage level V(i, j, k) indicated by the video data D(i, j, k) for the desired frame is applied.

The voltage level V1(i, j, k) is higher than the original voltage level V(i, j, k). This results in that applying that level of voltage continuously may therefore give rise to the pixel PIX(i, j) exceeding the brightness level L(i, j, k) indicated by the video data D(i, j, k) for the desired frame. However, in the present embodiment, since the voltage level V(i, j, k) is applied to the pixel PIX(i, j) in the current period T2, the brightness level does not exceed the brightness level L(i, j, k), but reaches the brightness level L(i, j, k) smoothly.

In the example in FIG. 5, the transition from the current tone to the desired tone is a "rise", but the transition from the previous tone to the current tone is not a "decay". Therefore, even if the response speed of the pixel PIX(i, j) is slow, and the transition from the previous tone to the current tone is insufficient, the pixel PIX(i, j) does not exceed the brightness level indicated by the video data D(i, j, k−1) for the current frame FR(k−1) at the start of the desired frame FR(k). Therefore, even if the output signal generating circuit 24 facilitates tone transition from the current frame FR(k−1) to the desired frame FR(k) on the basis of data from the ordinary modulation processing section 22, no shortcoming occurs where the pixel PIX(i, j) exceeds a desired brightness level L(i, j, k) and becomes excessively bright. As a result, the brightness rapidly changes to the level indicated by the video data D(i, j, k) for the desired frame FR(k), while retaining good display quality of the pixel PIX(i, j).

Meanwhile, when the transition from the previous tone through to the desired tone is a "decay" followed by a "rise", the flag memory 26 stores a "true" flag F(i, j, k−1) in the current frame FR(k−1). Besides, the voltage level V(i, j, k) indicated by the video data D(i, j, k) for the desired frame FR(k) is higher than the voltage level V(i, j, k−1) indicated by the video data D(i, j, k−1) stored in the current frame FR(k−1). When this is the event, the activation determination processing section 27 instructs the output signal generating circuit 24 to perform a specialized process.

Here, when the transition from the previous tone through to the desired tone is a "decay" followed by a "rise", if the response speed of the pixel PIX(i, j) is slow, and the transition from the previous tone to the current tone is insufficient, the pixel PIX(i, j) exceeds the brightness level indicated by the video data D(i, j, k−1) for the current frame FR(k−1). In such a case, if a voltage waveform Vm which facilitates tone transition so as to more rapidly increase the brightness level is applied to the pixel PIX(i, j) on the basis of data from the on the basis of data from ordinary modulation processing section 22 as indicated by a dash-dot line in FIG. 6, the pixel PIX(i, j) may become excessively bright, and greatly degrade the display quality of the image display 1.

In the present embodiment, however, the activation determination processing section 27 makes an instruction for a specialized process, and the output signal O(i, j, k) is generated on the basis of data from the specialized processing section 23. Here, the specialized processing section 23 of the present embodiment outputs the mean value of the output of the ordinary modulation processing section 22 and the video data D(i, j, k) for the desired frame FR(k). Therefore, as indicated by a bold solid line in FIG. 6, applied to the pixel PIX(i, j) is an intermediate voltage waveform between the voltage waveform Vo produced on the basis of data from ordinary modulation processing section 22 and the voltage waveform Vo produced when the exact level indicated by the video data D(i, j, k) is applied. This prevents the excess brightness from happening and restrains display quality degradation.

In this case, unless the transition from the previous tone to the current tone is sufficient, the pixel PIX(i, j) exceeds the brightness level indicated by the video data D(i, j, k−1) for the current frame FR(k−1) at the start of the desired frame FR(k). Therefore, the pixel PIX(i, j) reaches the brightness level indicated by the video data D(i, j, k) for the desired frame FR(k) at a sufficient speed although tone transition is less facilitated than in the case of the voltage waveform Vm.

Besides, in the present embodiment, in a specialized process, the voltage waveform Vx applied to the pixel PIX(i, j) is determined on the basis of the mean tone level of a tone level modulated by a normal process and an unmodulated tone level. Therefore, the greater the difference between the waveform Vm when a normal process is performed and the waveform Vo when no modulation is performed, the more the modulation is restricted. As a result, the greater modulation the pixel PIX(i, j) receives, and the lower the voltage level V(i, j, k) indicated by the video data D(i, j, k) for the desired frame FR(k), the more the modulation affect the brightness level. Therefore, in a normal process drive, the greater modulation the pixel PIX(i, j) receives, that is, the more easily the pixel PIX(i, j) is spotted by the user as showing excess brightness, the more the modulation is restricted, and the better the excess brightness is prevented from occurring.

Further, as in the foregoing, the video data D(i, j, k) for the previous frame affects the degree of the modulation of the voltage waveform applied to the pixel PIX(i, j) in the desired frame FR(k). Although the pixel PIX(i, j) can be driven at a sufficient response speed while preventing the occurrence of the excess brightness, the modulated-drive processing section 11 of the present embodiment stores nothing but the flag F(k−1) indicating the comparison result of the video data D(i, j, k−2) for the previous frame FR(k−2) and the video data D(i, j, k−1) for the current frame FR(k−1), except the video data D(i, j, k−1) for the current frame FR(k−1) stored in the frame memory 21. The storage capacity required for storage can be greatly reduced when compared to cases where the video data D(i, j, k−1) for the previous frame is stored. Especially, in the present embodiment, since whether or not the transition is a ""decay"" is binarized and stored as the flag F(k−1), a 1-bit capacitance per flag is sufficient. Therefore, the pixel PIX(i, j) can be driven at a sufficient response speed, using circuitry of a relatively small scale, while preventing the excess brightness from happening.

Embodiment 2

The present embodiment will describe an arrangement where tone transition is less facilitated than if otherwise (normal process), when the transition from the previous tone to the current tone is a "decay", the video data D(i, j, k−1) for the current frame FR(k−1) does not exceed a certain level, and the transition from the current tone to the desired tone is a "rise",.

The modulated-drive processing section 11*a* of the present embodiment has substantially the same arrangement as the modulated-drive processing section 11 of embodiment 1. However, the former includes a flag generating circuit 25*a* in place of the flag generating circuit 25 generating a "true" flag when the transition from the current tone to the desired tone is a "decay". The flag generating circuit 25*a* generates a flag F(i, j, k) for the desired frame FR(k) which indicates a "true" when the transition from the current tone to the desired tone is a "decay", and the video data D(i, j, k) for the desired frame FR(k) is less than or equal to a predetermined value.

According to the arrangement, a normal process is performed similarly to embodiment 1 when the transition from the current tone to the desired tone is a "decay", irrespective of whether the transition from the previous tone to the current tone is a "rise" or the transition from the previous tone to the current tone is a "decay". Besides, a specialized process is performed similarly to embodiment 1 when the transition from the previous tone through the current tone to the desired tone is a "decay" followed by a "rise", and when the video data D(i, j, k−1) for the current frame FR(k−1) is less than or equal to the value. This is because the flag F(i, j, k−1) read from the flag memory 26 in the desired frame FR(k) is true. Therefore, in these cases, the excess brightness is prevented from occurring similarly to embodiment 1. As a result, the brightness rapidly changes to the level indicated by the video data D(i, j, k) for the desired frame FR(k), using circuitry of a relatively small scale, while retaining good display quality of the pixel PIX(i, j).

Further, in the present embodiment, when the video data D(i, j, k−1) for the current frame FR(k−1) exceeds the value, a "false" flag F is stored in the flag memory 26 in the current frame FR(k−1). Therefore, even when the transition from the previous tone through the current tone to the desired tone is a "decay" followed by a "rise", a normal process is performed.

Here, when the video data D(i, j, k−1) for the current frame FR(k−1) exceeds the value, the pixel PIX(i, j) should reach a relatively high brightness level L(i, j, k−1) in the transition from the previous tone to the current tone. For this reason, there is sufficient room for modulation. For example, supposing that the pixel PIX(i, j) can display 256 tones, a "decay" down to tone level 32 can be enhanced for as few as 31 tones even with the best tone transition facilitation/enhancement in a normal process. Meanwhile, a "decay" down to tone level 128 can be modulated by a normal process so that the "decay" is enhanced for a further 127 tones.

As a result, when the response speed of the pixel PIX(i, j) is as follows, that is, when the video data D(i, j, k−1) is less than or equal to the value, despite speed at which the pixel PIX(i, j) does not fall to the brightness level L(i, j, k−1) even after the current frame FR(k−1) ends, it is likely to reach the desired brightness level L(i, j, k−1), if the video data D(i, j, k−1) exceeds the above-mentioned value.

Therefore, as in the present embodiment, even when the transition from the previous tone through the current tone to the desired tone is a "decay" followed by a "rise", the response speed of the pixel PIX(i, j) is improved over the case of a specialized process by facilitating tone transition by a normal process in comparison to the case of a specialized process if the brightness level in the current frame FR(k−1) exceeds the value. Note that in this case, since the pixel PIX(i, j) has reached the brightness level L(i, j, k−1) indicated by the video data D(i, j, k−1) for the current frame FR(k−1) at the start of the desired frame FR(k), a normal process does not cause excess brightness.

Embodiment 3

The present embodiment will describe an arrangement where tone transition is less facilitated than if otherwise (normal process), if the transition from the previous tone to the current tone is a "decay", the differential signal of the two is more than or equal to a certain level, and the transition from the current tone to the desired tone is a "rise".

The modulated-drive processing section 11*b* of the present embodiment has substantially the same arrangement as the modulated-drive processing section 11 of embodiment 1. However, the former includes a flag generating circuit 25*b* in place of the flag generating circuit 25 generating a "true" flag when the transition from the current tone to the desired tone is a "decay". The flag generating circuit 25*b* generates a flag F(i, j, k) for the desired frame FR(k) which indicates a "true" when the transition from the current tone to the desired tone is a "decay", and the differential signal level (tone transition width) of the two is more than or equal to a predetermined value.

According to the arrangement, a normal process is performed similarly to embodiment 1 when the transition from the current tone to the desired tone is a "decay", irrespective of whether the transition from the previous tone to the current tone is a "rise" or a "decay". Besides, a specialized process is performed similarly to embodiment 1 when the transition from the previous tone through the current tone to the desired tone is a "decay" followed by a "rise", and the width of the transition from the previous tone to the current tone is more than or equal to the value, since the flag F(i, j, k−1) read from the flag memory 26 the desired frame FR(k) is true. Therefore, in these cases, the excess brightness is prevented from occurring similarly to embodiment 1. As a result, the brightness rapidly changes to the level indicated by the video data D(i, j, k) for the desired frame FR(k), using circuitry of a relatively small scale, while retaining good display quality of the pixel PIX(i, j).

Further, in the present embodiment, when the width of the transition from the previous tone to the current tone is less than the value, a "false" flag F is stored in the flag memory 26 in the current frame FR(k−1). Therefore, even when the transition from the previous tone through the current tone to the desired tone is a "decay" followed by a "rise", a normal process is performed.

Here, if it is strictly determined only whether or not the transition from the previous tone through the current tone to the desired tone is a "decay" followed by a "rise" when the video data D(i, j, k) for the frames FR(k) have substantially the same value, such as when the input video signal DAT can be regarded in effect as representing a still image for example, some pixels are driven by a normal process. Other pixels, however, are driven by a specialized process. This causes irregularities in the displayed image, on the image display 1, which is in effect a still image.

In the present embodiment, however, a normal process is performed, irrespective of whether the transition from the previous tone through to the desired tone is a "decay" followed by a "rise", when the video data D(i, j, k) for the frames FR(k) have substantially the same value (when the difference is less than or equal to the value). Therefore, even when the input video signal DAT can be regarded in effect as representing a still image, no display irregularities occurs, and the display quality of the image display 1 is improved.

Note that if the width of the transition from the previous tone to the current tone is less than the value, the pixel PIX(i, j) will have presumably reached the brightness level L(i, j, k−1) indicated by the video data D(i, j, k−1) for the current frame FR(k−1) at the start of the desired frame FR(k). Besides, if the value is sufficient small, the response speed of the pixel PIX(i, j) is very slow; even if the pixel PIX(i, j) has not reached the brightness level L(i, j, k−1), the error between the actual brightness level and the brightness level L(i, j, k−1) is small. Therefore, in these cases, no excess brightness occurs in a normal process.

Embodiment 4

The present embodiment will describe an arrangement where tone transition is less facilitated than if otherwise (normal process), if the transition from the previous tone to the current tone is a "decay", the differential signal level of the two is substantially more than or equal to the mean brightness level of the display tones, multiplied by a constant value, and the transition from the current tone to the desired tone is a "rise".

The modulated-drive processing section 11*c* of the present embodiment has substantially the same arrangement as the modulated-drive processing section 11 of embodiment 1; however, the former includes a flag generating circuit 25*c* in place of the flag generating circuit 25 generating a "true" flag when the transition from the current tone to the desired tone is a "decay". The flag generating circuit 25*c* generates a flag F(i, j, k) for the desired frame FR(k) which indicates a "true" when the transition from the current tone to the desired tone is a "decay", and the differential signal level (tone transition width) of the two is substantially more than or equal to the mean brightness level of the display tones, multiplied by a constant value.

According to the present embodiment, as an example, the level distinguishing between differential signals is changed in accordance with the mean brightness level across the whole image displayed by the image display 1. The flag F(i, j, k) is set to a "true" when the differential signal level more than or equal to the mean brightness level across the whole image, multiplied by a constant value, and the transition from the current tone to the desired tone is a "decay".

According to the arrangement, a normal process is performed similarly to embodiment 1 when the transition from the current tone to the desired tone is a "decay", irrespective of whether the transition from the previous tone to the current tone is a "rise" or a "decay". Besides, a specialized process is performed similarly to embodiment 1 when the transition from the previous tone through the current tone to the desired tone is a "decay" followed by a "rise", and when the width of the transition from the previous tone to the current tone is substantially more than or equal to the mean brightness level of the display tones, multiplied by a constant value. This is because the flag F(i, j, k−1) read from the flag memory 26 is true in the desired frame FR(k). Therefore, in these cases, the excess brightness is prevented from occurring similarly to embodiment 1. As a result, the brightness rapidly changes to the level indicated by the video data D(i, j, k) for the desired frame FR(k), using circuitry of a relatively small scale, while retaining good display quality of the pixel PIX(i, j).

Further, in the present embodiment, when the width of the transition from the previous tone to the current tone is less than substantially the mean brightness level of the display tones, multiplied by a constant value, a "false" flag F is stored in the flag memory 26 the current frame FR(k−1). Therefore, even when the transition from the previous tone through the current tone to the desired tone is a "decay" followed by a "rise", a normal process is performed.

According to the arrangement, when the transition from the previous tone through to the desired tone is a "decay" followed by a "rise", the number of pixels PIX(i, j) undergoing a specialized process and that of pixels PIX(i, j) undergoing a normal process are set in accordance with the mean brightness level of the display tones. Therefore, the display area occupied by the pixels PIX(i, j) driven by a specialized process can be limited so as not to exceed a predetermined proportion of the display area with respect to the display screen area of the image display 1.

As a result, the user will not notice the following shortcomings: the brightness level of the pixels PIX(i, j) become so low that the screen overall appears rather dark, due to restrained tone transition facilitation by a specialized process, and the response speed of the pixels PIX(i, j) falls due to restrained tone transition facilitation. Display quality is thus improved by restraining excess brightness due to a specialized process.

In some cases, the overall brightness level of a target graphical pattern may be compressed because of, among others, shooting position and angle, user's brightness setting, automatic brightness adjustment in response to ambient light. Here, the mean tone transition in a particular situation is dictated by the overall brightness level provided that the graphical pattern remains unchanged. Meanwhile, since liquid crystal's response is typically slow and difficult to control if the brightness difference (voltage difference) is small, the proportion of desirable tone transition increases by adjusting the degree of modulation through a specialized process. Therefore, even if the transition from the current tone to the desired tone is a "decay" as in the present embodiment, the arrangement where it is decided in accordance with the mean brightness level whether or not a "true" flag is stored does not allow the user to notice the shortcomings and limits excess brightness caused by a specialized process, and thus improves display quality.

Embodiment 5

The present embodiment will describe an arrangement where tone transition is less facilitated than if otherwise (normal process), if the transition from the previous tone to the current tone is a "decay", the difference between the video data D(i, j, k−2) for the previous frame FR(k−2) multiplied by a constant value and the video data D(i, j, k−1) for the current frame FR(k−1) is more than or equal to a predetermined value, and the transition from the current tone to the desired tone is a "rise".

The modulated-drive processing section 11*d* of the present embodiment has substantially the same arrangement as the modulated-drive processing section 11 of embodiment 1. However, the former includes a flag generating circuit 25*d* in place of the flag generating circuit 25 generating a "true" flag when the transition from the current tone to the desired tone is a "decay". The flag generating circuit 25*d* generates a flag F(i, j, k) for the desired frame FR(k) which indicates a "true", when the transition from the current tone to the desired tone is a "decay" and when the difference between the video data D(i, j, k−1) for the current frame FR(k−1) multiplied by a constant value and the video data D(i, j, k) for the desired frame FR(k) is more than or equal to a predetermined value.

In the present embodiment, for ease in computing, the constant value in the multiplication is set to 0.5 as an example. In addition, the "predetermined" value is preferably 4 to 16 when the video data D(i, j, k) is expressed by 8 bits (256 tones).

According to the arrangement, similarly to embodiment 1, a normal process is performed if the transition from the current tone to the desired tone is a "decay", irrespective of whether the transition from the previous tone to the current tone is a "rise" or a "decay". Besides, since the flag F(i, j, k−1) read from the flag memory 26 in the desired frame FR(k) is true, a specialized process is performed similarly to embodiment 1 if the transition from the previous tone through the current tone to the desired tone is a "decay" followed by a "rise", and if the difference between the video data D(i, j, k−2) for the previous frame FR(k−2) multiplied by a constant value and the video data D(i, j, k−1) for the current frame FR(k−1) is more than or equal to the predetermined value. Therefore, in these cases, the excess brightness is prevented from occurring similarly to embodiment 1. As a result, the brightness rapidly changes to the level indicated by the video data D(i, j, k) for the desired frame FR(k), using circuitry of a relatively small scale, while retaining good display quality of the pixel PIX(i, j).

Further, in the present embodiment, a false flag F is stored in the flag memory 26 for the current frame FR(k−1) if the difference between the video data D(i, j, k−2) for the previous frame FR(k−2) multiplied by a constant value and the video data D(i, j, k−1) for the current frame FR(k−1) are less than the predetermined value. Therefore, a normal process is performed even when the transition from the previous tone through to the desired tone is a "decay" followed by a "rise".

According to the arrangement, it is determined whether or not to drive by a specialized process when the transition from the previous tone through the current tone to the desired tone is a "decay" followed by a "rise", depending on whether or not the difference between the video data D(i, j, k−2) for the previous frame FR(k−2) multiplied by a constant value and the video data D(i, j, k−1) for the current frame FR(k−1) is not less than the predetermined value. Therefore, the lower tone the video data D(i, j, k−1) for the current frame FR(k−1) represents for the pixel PIX(i, j), that is, the more likely the pixel PIX(i, j) has not sufficiently dropped its brightness level in the transition from the previous tone to the current tone, the more likely the pixel PIX(i, j) will be driven by a specialized process.

Therefore, the occurrence of excess brightness is limited effectively for improved display quality without allowing the user to notice the aforementioned shortcomings, that is, the screen overall appears rather dark, due to frequent performing of the specialized process, and the response speed of the pixels PIX(i, j) falls due to restrained tone transition facilitation.

The foregoing description illustrated an example arrangement where (a) a "true" flag is generated as the flag F(i, j, k) for the desired frame FR(k) when the transition from the current tone to the desired tone is a "decay" and (b) the difference between the video data D(i, j, k−1) for the current frame FR(k−1) multiplied by a constant value and the video data D(i, j, k) for the desired frame FR(k) is more than or equal to the predetermined value. Alternatively, a "true" flag may be stored when the difference between the video data D(i, j, k−1) for the current frame FR(k−1) and the desired frame FR(k) multiplied by a constant value (for example, multiplied by 2) is equal to or more than a predetermined value, and the transition from the current tone to the desired tone is a "decay". In either case, similar effects are obtainable by giving proper weight to the video data D(i, j, k−1) for the current frame FR(k−1) and the video data D(i, j, k) for the desired frame FR(k) so as to increase the contribution from the video data D(i, j, k) for the desired frame FR(k) and thereafter storing a "true" flag when the difference is equal to or more than a predetermined value, and the transition from the current tone to the desired tone is a "decay".

Embodiment 6

Embodiments 1 to 5 described arrangements where a specialized process applies to the pixel PIX(i, j), a mean waveform Vx between the voltage waveform Vm as modulated by a normal process and the unmodulated voltage waveform Vo. The present embodiment will describe an arrangement where a specialized process applies an unmodulated voltage waveform Vo as the voltage waveform Vx, less modulated than a normal process. The arrangement is applicable to any of embodiments 1 to 5. The following will describe an application to embodiment 1 as an example.

Figure 7:
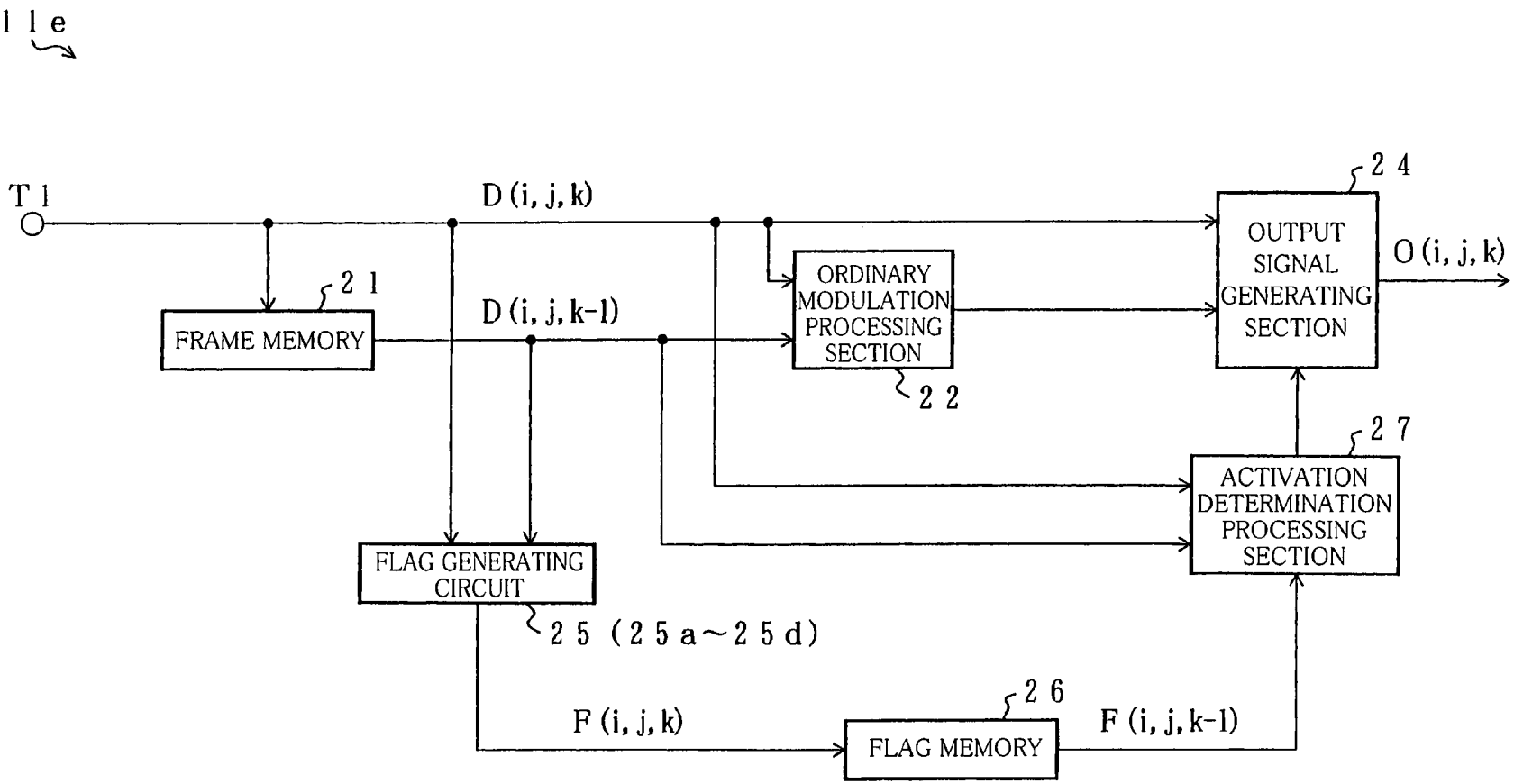
FIG. 7, illustrating another embodiment in accordance with the present invention, is a block diagram of a major part of the arrangement of a modulated-drive processing section.
Figure 8:
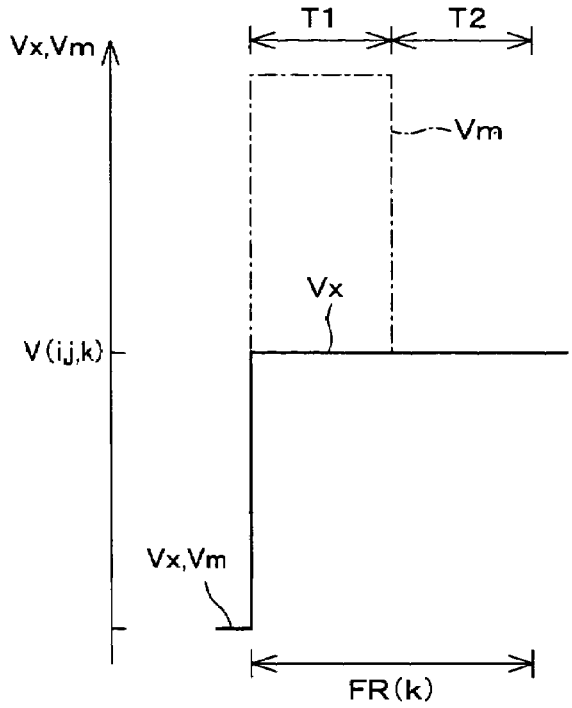
FIG. 8, illustrating operation of the modulated-drive processing section, is a timing chart showing a pixel-applied voltage level in a specialized process.

Specifically, as shown in FIG. 7, in the modulated-drive processing section 11*e* of the present embodiment, the specialized processing section 23 in FIG. 1 is omitted. When an instruction is made for a specialized process, starting in the first period T1 of the desired frame FR(k), the output signal generating circuit 24 outputs an output signal O(i, j, k) on the basis of the video data D(i, j, k) for the desired frame FR(k), so as to apply the voltage V(i, j, k) having a level as indicated by the video data D(i, j, k) to the pixel PIX(i, j). Thus, the voltage V(i, j, k) having a level indicated by the video data D(i, j, k) is applied to the pixel PIX(i, j) from the first period T1 through the current period T2 of the desired frame FR(k) as shown in FIG. 8.

In this arrangement, a specialized process also applies a voltage waveform less modulated than a normal process to the pixel PIX(i, j). Therefore, similarly to the foregoing embodiments, the brightness rapidly changes to the level indicated by the video data D(i, j, k) for the desired frame FR(k), using circuitry of a relatively small scale, while excess brightness is prevented from occurring, and good display quality of the pixel PIX(i, j) is retained.

Besides, the present embodiment does not include the specialized processing section 23. The voltage V(i, j, k) having a level as indicated by the video data D(i, j, k) is applied to the pixel PIX(i, j) the first period T1. The modulated-drive processing section 11*f* is realized with further reduced circuit dimensions.

Embodiment 7

The present embodiment will describe an arrangement where a specialized process generates a voltage waveform Vx for application to a pixel on the basis of a tone level produced by weight-averaging with certain weights the tone level modulated by a normal process and the unmodulated tone level, as another example of a voltage waveform less modulated than a normal process. The arrangement is again applicable to any of embodiments 1 to 5. The following will describe an application to embodiment 1 as an example.

Specifically, as shown in FIG. 1, in the modulated-drive processing section 11*f* of the present embodiment, a specialized processing section 23*f* is provided in place of the specialized processing section 23 of embodiments 1 to 5. The specialized processing section 23*f* outputs a value produced by the weight-averaging with predetermined weights the output from the ordinary modulation processing section 22 and the video data D(i, j, k) for the desired frame FR(k). The weights are specified to make the modulation as great as possible within such a range that does not cause excess brightness.

Figure 9:
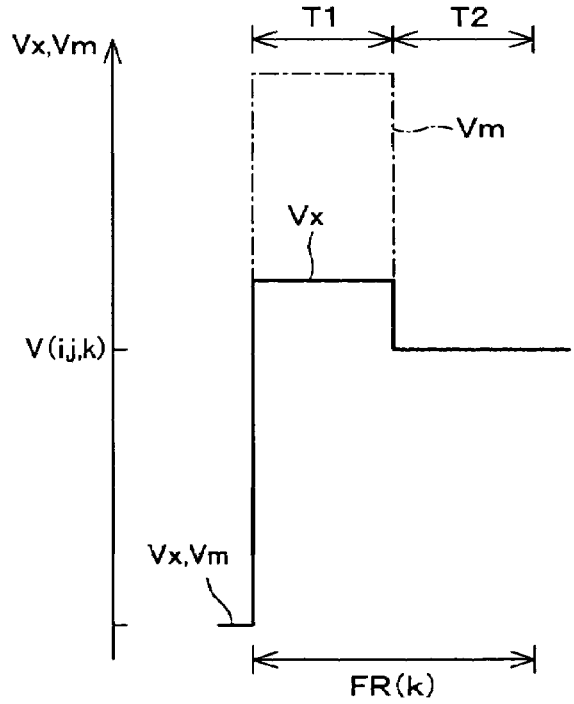
FIG. 9, illustrating another embodiment in accordance with the present invention, is a timing chart showing a pixel-applied voltage level in a specialized process.

According to the arrangement, when an instruction is made for a specialized process, as shown in FIG. 9, applied to the pixel PIX(i, j) is a voltage V1(i, j, k) in accordance with the tone level derived by weight-averaging with the weights a tone level corresponding to a voltage level applied to the pixel PIX(i, j) in the period T1 by a normal process and a tone level corresponding to the voltage level V(i, j, k) indicated by the video data D(i, j, k).

In the arrangement, a specialized process again applies a voltage waveform less modulated than a normal process to the pixel PIX(i, j). Therefore, similarly to the foregoing embodiments, the brightness rapidly changes to the level indicated by the video data D(i, j, k) for the desired frame FR(k), using circuitry of a relatively small scale, while excess brightness is prevented from occurring, and good display quality of the pixel PIX(i, j) is retained.

The foregoing description illustrated an arrangement where tone levels are weight-averaged. Substantially the same effects can be achieved by an arrangement where the voltage levels per se are weight-averaged, because that arrangement can limit modulation. Generating a signal weight-averaged with constant weights from an actual voltage, however, requires a substantial scale of additional circuitry and presents such difficulty in changing the operation of the additional circuitry when a module is changed that the arrangement becomes less versatile in applying to another module. Therefore, controlling tone level (digital values like 0 to 255) as in the present embodiment, rather than varying the actual voltage with certain weights, allows for simplification of the circuit arrangements of the modulated-drive processing section (e.g., 11*f*) and improves versatility of the modulated-drive processing section in applying to another module.

Embodiment 8

In the modulated-drive processing section 11*f* of embodiment 7, optimal weights for average weight (internal division ratio) are varied depending on various conditions (for example, display device temperature). The present embodiment will describe an arrangement where a voltage waveform Vx can be applied to the pixel PIX(i, j) based on a tone level produced by the weight average with weights in accordance with conditions, no matter how the conditions may vary. One can conceive many specific examples of the conditions. An arrangement will be taken as an example and described where the display device temperature is varied as a condition that easily affects the weights, because it easily affects the liquid crystal response speed.

Figure 10:
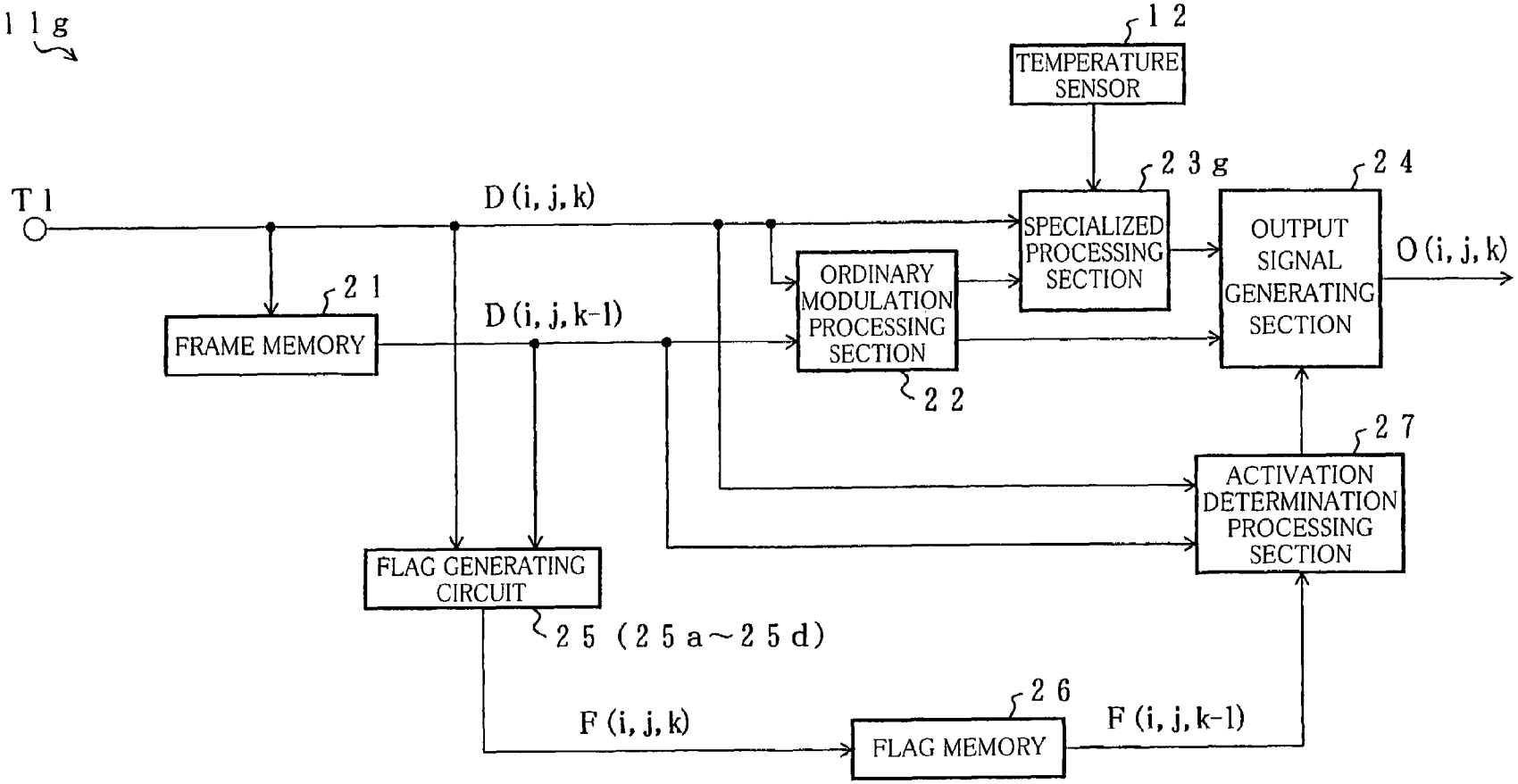
FIG. 10, illustrating another embodiment in accordance with the present invention, is a block diagram of a major part of the arrangement of a modulated-drive processing section.

Specifically, the modulated-drive processing section 11*g* of the present embodiment has substantially the same arrangement as the modulated-drive processing section 11*f* of embodiment 7; the former further includes a temperature sensor 12 mounted to the display to detect the temperature of the device as shown in FIG. 10. Besides, a specialized processing section 23*g*, provided in place of the specialized processing section 23*f*, outputs data to apply to the pixel PIX(i, j) a voltage waveform Vx in accordance with a tone level produced by weight-averaging the tone level indicating the voltage waveform Vm in a normal process and the tone level indicating the unmodulated voltage waveform Vo, at weights in accordance with temperature information from the temperature sensor 12.

Here, the relationship between the temperature information and the weights are not linear and is difficult to express using mathematical terms. Therefore, the specialized processing section 23*g* of the present embodiment is given an LUT pre-recording weights corresponding to temperature information for a readout of weights in accordance with the temperature information from the temperature sensor 12. The specialized processing section 23*g* thus prepares weights in accordance with temperature information using small-scale circuitry compared to approximation using a complex approximate expression.

In this manner, in the present embodiment, a sensor (temperature sensor 12) is provided to detect conditions, and a voltage waveform Vx is generated on the basis of a tone level produced by weight average with weights in accordance with conditions, no matter how the conditions may vary, and applied to the pixel PIX(i, j).

Therefore, a voltage waveform Vx is generated on the basis of a tone level of weights for modulation as great as possible within such a range that does not cause excess brightness for any conditions. As a result, the occurrence of excess brightness is limited effectively for improved display quality without allowing the user to notice the aforementioned shortcomings, that is, the screen overall appears rather dark, due to frequent performing of the specialized process, and the response speed of the pixels PIX(i, j) falls due to restrained tone transition facilitation.

Embodiment 9

In embodiments 1 to 5, 7, and 8, the specialized processing section (23, 23*f*, 23*g*) computes data indicating a voltage V1(i, j, k) to be applied to the pixel PIX(i, j) in the period T1. In contrast, the present embodiment will describe an arrangement where the data indicating the voltage V1(i, j, k) is derived using an LUT. The present embodiment is applicable to any of these previous embodiments; the following will however describe for convenience in illustration application to embodiment 1 as an example.

Figure 11:
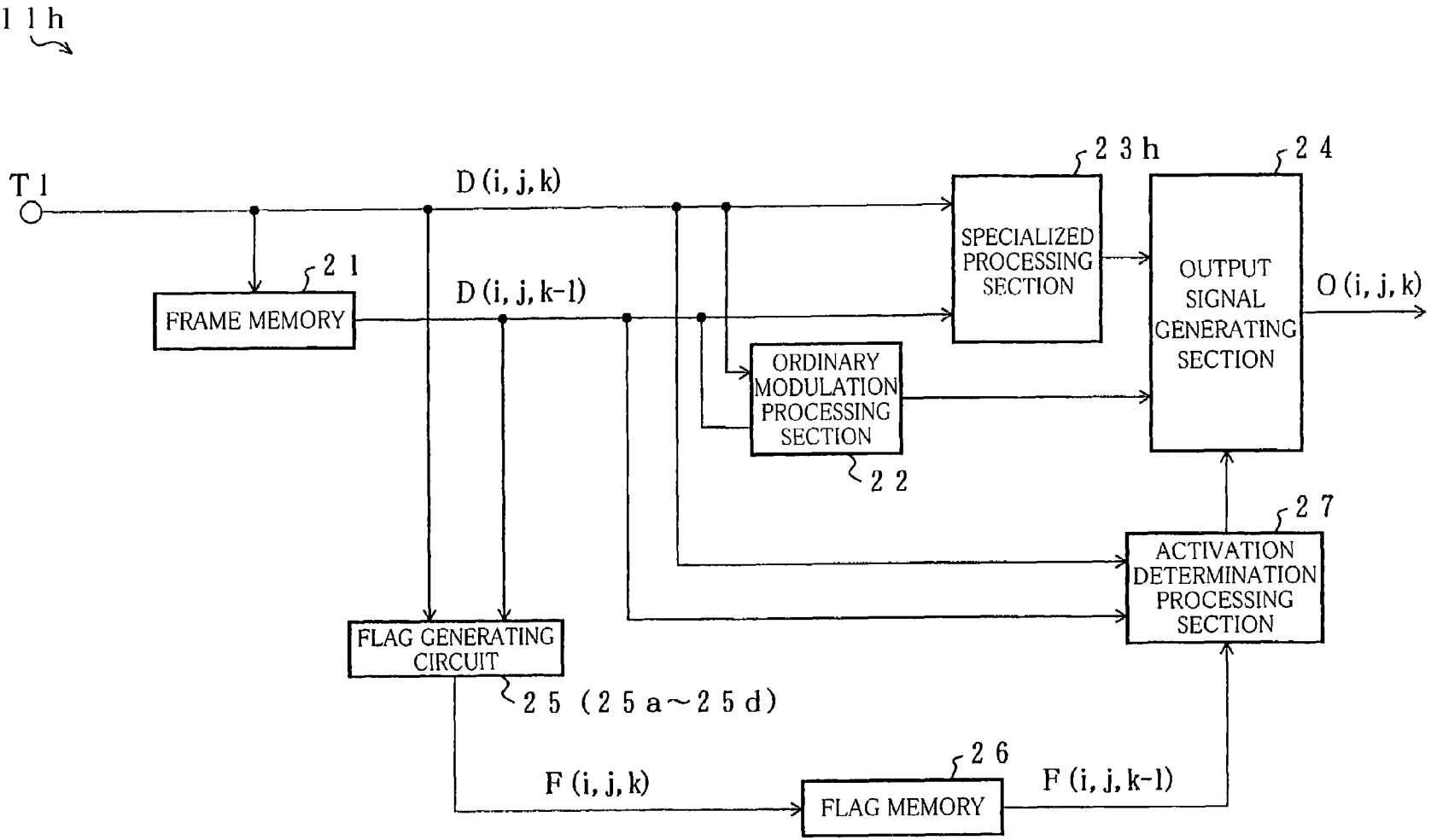
FIG. 11, illustrating another embodiment in accordance with the present invention, is a block diagram of a major part of the arrangement of a modulated-drive processing section.
Figure 12:
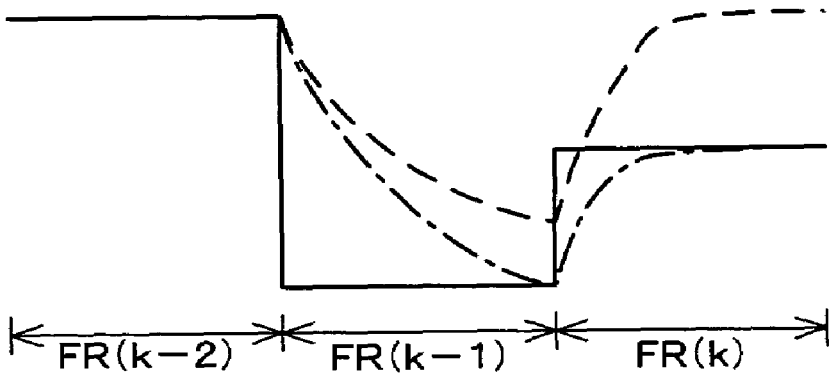
FIG. 12, illustrating conventional technology, is a timing chart showing an actually brightness level when transition from the previous tone through to the desired tone is a "decay" followed by a "rise".

The modulated-drive processing section 11*h* of the present embodiment includes a specialized processing section 23*h* as shown in FIG. 11 in place of the specialized processing section 23 in FIG. 1. The specialized processing section 23*h* stores in the form of an LUT data for output in a specialized process about respective combination of the video data D(i, j, k−1) for the current frame FR(k−1) and the video data D(i, j, k) for the desired frame FR(k). Thus, when both the video data D(i, j, k−1) and D(i, j, k) are received, the specialized processing section 23*h* outputs to the output signal generating circuit 24 data in accordance with the video data and applies a voltage waveform Vx in a specialized process to the pixel PIX(i, j).

In the present embodiment, since the specialized processing section 23*h* is realized as an LUT, the specialized processing section 23*h* capable of outputting data at high precision in accordance with any combination of incoming video data D(i, j, k−1) and D(i, j, k) can be realized using small-scale circuitry. Thus, a more versatile specialized process can be carried out, without any problems, even if an output from the ordinary modulation processing section 22 is referenced, even in a case where an expression approximating data corresponding to the combinations to a high precision cannot be evaluated using small-scale circuitry.

The forgoing illustrated a case as an example where two LUTs are provided, one for a specialized process and another for a normal process, selectively used in accordance with an instruction from the activation determination processing section 27. Alternatively, multiple LUTs may be provided to each temperature, and the content of an LUT may be changed from panel to panel. Besides, when the specialized processing section is realized using an LUT, the determination by the activation determination processing section can be entirely or partially invalidated by storing the same value as in a normal process in accordance with such a combination of inputs to the LUT that the activation determination processing section makes an instruction for a normal process despite a true flag F(i, j, k−1). Therefore, the circuit arrangement of the modulated-drive processing section can be further simplified.

Embodiment 10

Embodiments 1 to 9 described a case where a specialized process is performed when (a) the flag F(i, j, k−1) is true and (b) the tone ranges of the video data D(i, j, k−1) and D(i, j, k) for the desired and current frames FR(k) and FR(k−1) respectively fall in the following range, that is, such a range that the tone transition is a "rise".

In contrast, the following will describe an arrangement where a specialized process is performed a condition as another tone range is met that the video data D(i, j, k−1) for the current frame FR(k−1) is less than or equal to a predetermined tone level. The present arrangement is applicable to any of the foregoing embodiments; the following will, however, describe application to embodiment 1 as an example for convenience in description.

The modulated-drive processing section 11*i* of the present embodiment includes a an activation determination processing section 27*i* in place of the activation determination processing section 27 in FIG. 1. The activation determination processing section 27*i* causes a specialized process when the flag F(i, j, k−1) is true and when the video data D(i, j, k−1) for the current frame FR(k−1) is less than or equal to a predetermined tone level. In the present embodiment, as an example, the tone level is set to either 128 tones or 96 tones when the video data is expressed by 8 bits (256 tones).

According to the arrangement, the activation determination processing section 27*i* causes that the pixel PIX(i, j) is driven by a specialized process when the video data D(i, j, k−1) for the current frame FR(k−1) is less than or equal to a predetermined tone level and when the flag F(i, j, k−1) is a true. Therefore, the pixel PIX(i, j) in consideration, that is, the pixel PIX(i, j) of which the brightness level is likely to have not sufficiently dropped in the transition from the previous tone to the current tone, that is, the pixel PIX(i, j) which is likely to cause excess brightness if driven by a normal process, is driven by a voltage waveform which facilitates the tone transition less than a normal process. As a result, occurrence of excess brightness is prevented, and the image display 1 maintains good display quality.

In contrast, when the video data D(i, j, k−1) for the current frame FR(k−1) exceeds the predetermined tone level, the activation determination processing section 27*i* causes that the pixel PIX(i, j) is driven by a normal process regardless of the value of the flag F(i, j, k−1). Therefore, the pixel PIX(i, j) in consideration, that is, the pixel PIX(i, j) which is likely to have completely dropped its brightness level in the transition from the previous tone to the current tone and which is unlikely to cause excess brightness when driven by a normal process, is driven by a normal process.

As a result, unlike an arrangement where a specialized process is performed for every pixel PIX(i, j), the user is prevented from noticing the aforementioned shortcomings, that is, the screen overall appears rather dark, due to frequent performing of the specialized process, and the response speed of the pixels PIX(i, j) falls due to restrained tone transition facilitation. As a result, the brightness rapidly changes to the level indicated by the video data D(i, j, k) for the desired frame FR(k), using circuitry of a relatively small scale, while retaining good display quality of the pixel PIX(i, j).

Besides, according to the arrangement, when the video data D(i, j, k−1) for the current frame FR(k−1) exceeds the predetermined tone level, a normal process is performed. Here, when the video data D(i, j, k−1) exceeds the predetermined tone level, tone transition is facilitated by a relatively small amount by a normal process, and difference is small between the brightness level of the pixel PIX(i, j) driven by a normal process and the brightness level of the pixel PIX(i, j) driven without modulation.

Therefore, when the specialized processing section is realized in the form of an LUT and when there is a strong demand for reduction in circuit dimensions, circuit dimensions can be reduced better by excluding these cases from the application of a specialized process than a specialized process being performed covering these cases too even if the flag F(i, j, k−1) is true. For example, supposing that no specialized process is performed when the pixel PIX(i, j) can display 256 tones, and the video data D(i, j, k−1) for the current frame FR(k−1) is more than or equal to 128 tone levels, the specialized processing section can be realized using an LUT half the size as that in cases where a specialized process is performed for every tone level.

The foregoing described as a condition to perform a specialized process, the tone range being in the following range, that is, such a range that the tone transition is a "rise", or the video data D(i, j, k−1) for the current frame FR(k−1) is less than or equal to a predetermined tone level. Substantially the same effects are achievable under different conditions if a specialized process is limited for the pixel PIX(i, j) which is likely to have dropped its brightness level sufficiently completely in the transition from the previous tone to the current tone and which is unlikely to cause excess brightness when driven by a normal process.

Embodiment 11

Embodiments 1 to 10 described by way of examples cases where the activation determination processing section 27 (27*i*) determines tone-related conditions through computation. An LUT may be referenced. Although the present arrangement is applicable to any of the embodiments, the following will describe an application to embodiment 1 as an example for convenience in description.

Specifically, the modulated-drive processing section 11*j* of the present embodiment includes an activation determination processing section 27*j* in place of the activation determination processing section 27. The activation determination processing section 27*j* is an LUT storing data indicating whether or not a specialized process is performed for all pieces of data forming a criterion for determination (or their combinations). For example, when the video data D(i, j, k−1) for the current frame FR(k−1) and the video data D(i, j, k) for the desired frame FR(k) are required to determine whether in or out of tone range, data indicating whether to perform a specialized process is stored for every combination of the two. Data indicating whether to perform a specialized process is output in accordance with input data which acts as a criterion in determination. If only one of the two is necessary to determine whether in or out of tone range, data indicating whether to perform a specialized process is stored for every value of the necessary data.

According to the arrangement, even if the computation in determining from the data acting as a determining criterion whether to perform a specialized process cannot be realized using small-scale circuitry, the activation determination processing section 27*j* capable of outputting, from data acting as a determining criterion, data indicating whether to perform a specialized process can be realized using small-scale circuitry without any problems. Therefore, the specialized process can be selected more freely and performed only for tone ranges which really require the specialized process.

As a result, the occurrence of excess brightness is limited effectively for improved display quality without allowing the user to notice the aforementioned shortcomings, that is, the screen overall appears rather dark, due to frequent performing of the specialized process, and the response speed of the pixels PIX(i, j) falls due to restrained tone transition facilitation. Therefore, the brightness rapidly changes to the level indicated by the video data D(i, j, k) for the desired frame FR(k), using circuitry of a relatively small scale, while retaining good display quality of the pixel PIX(i, j).

Embodiment 12

The foregoing embodiments described a 1-bit flag F(i, j, k−1), either "true" or "false," stored in a flag memory as an example. Alternatively, a multiple bit flag may be stored. Although the present arrangement is applicable to any of the embodiments, the following will describe an application to embodiment 1 as an example for convenience in description.

In the modulated-drive processing section 11*k* of the present embodiment, the output signal generating circuit 24, the flag generating circuit 25, the flag memory 26, and the activation determination processing section 27 are replaced with multiple bit equivalents 24*k*, 25*k*, 26*k*, and 27*k* respectively. The output signal generating circuit 24*k* is capable of performing a specialized process at discrete levels. In performing a specialized process, the flag generating circuit 25*k* generates a flag indicating the level at which the specialized process is performed, on the basis of the video data D(i, j, k−1) for the current frame FR(k−1) and the video data D(i, j, k) for the desired frame FR(k), and stores it as the flag F(i, j, k) for the desired frame FR(k) in the flag memory 26*k*.

In the present embodiment, a 2-bit flag F(i, j, k−1) is stored. The output signal generating circuit 24*k* is capable of performing a facilitation process with one of three different levels: the first level which least facilitates tone transition, the third level which most facilitates tone transition of all the levels, but not as much as a normal process, and the second level which falls between the preceding two levels. Note that if the flag F(i, j, k−1) indicates no performance of a specialized process, the output signal generating circuit 24*k* drives the pixel PIX(i, j) by a normal process regardless of the other conditions.

According to the arrangement, a result of comparison of the video data D(i, j, k−2) for the previous frame FR(k−2) with the video data D(i, j, k−1) for the current frame FR(k−1) is stored as a multiple bit flag, and the pixel PIX(i, j) is driven by either a normal process or a specialized process having a level as indicated by the flag.

Therefore, the result of comparison of the video data D(i, j, k−1) and D(i, j, k) is suitably reflected by the level of tone transition facilitation in driving the pixel PIX(i, j) when compared to a specialized process having a single level. In this case, the modulated-drive processing section 11*k* is again realized using circuitry of a relatively small scale, because the storage capacity for the flag is smaller than the video data D(i, j, k−2) for the previous frame.

Embodiment 13

In the present embodiment, there is provided a flag generating circuit 25*m* in place of the flag generating circuit 25*k*. When the flag F(i, j, k−1) stored in the flag memory 26*k* in the current frame FR(k−1) indicates one of the levels and the image is determined to be a still image, the flag generating circuit 25*m* stores a flag indicating a specialized process having a lower level (tone transition facilitation at a greater degree) than the flag F(i, j, k−1) as the flag F(i, j, k) for the desired frame FR(k) in the flag memory 26*k*.

The flag generating circuit 25*k* determines whether the image is a still image, by, for example, determining that it is a still image when the tone change from the current frame FR(k−1) to the desired frame FR(k) does not exceed noise level.

Here, when the transition from the tone before the previous tone to the current tone is a "decay" followed by a still image, the pixel PIX(i, j) may not sufficiently drop its brightness level in the transition from the previous tone to the current tone, unless the pixel PIX(i, j) has dropped the brightness level in the transition from the tone before the previous tone to the previous tone by some amount. In such cases, if the pixel PIX(i, j) is driven by a normal process in the desired frame FR(k) when the transition from the current tone to the desired tone is a "rise", the pixel PIX(i, j) may exceed the brightness level indicated by the video data D(i, j, k) and causes excess brightness although the excess brightness may not as great as when the transition from the previous tone through the current tone to the desired tone is a "decay" followed by a "rise".

In contrast, in the present embodiment, the flag F(i, j, k−1) stored in the flag memory 26*k* in the current frame FR(k−1) indicates one of the levels. In addition, when the image is determined to be a still image, a flag indicating a specialized process having a lower level (tone transition facilitation at a greater degree) than the flag F(i, j, k−1) (tone transition facilitation having a higher level ) is stored as the flag F(i, j, k) for the desired frame FR(k) in the flag memory 26*k*. Therefore, if a tone transition requires a specialized process when there is no still image state, a specialized process having a lower level (tone transition facilitation at a greater degree) is performed than when there is no still image state. As a result, even if there is an intervening still image state, excess brightness is prevented from occurring.

Note that when the image display 1 can assign too small a fraction of system resources to the specialized process to describe multiple processes, the same process may be repeated until the shortage in a "decay" is resolved. As an example, suppose that flags of 2-bit can be stored which indicate a specialized process corresponding to one of level 3, level 2, and level 1 in descending order of degree of restricting tone transition facilitating modulation. With respect to the tone transition of a "decay", the flags of 2-bit are set so as to correspond to the level 3 and are consecutively changed and set so as to correspond to the level 3, the level 2, and the level 1, and level 0 (normal process) every time the still state continues. When a "rise" tone transition occurs during setting of the flags of 2-bit so as to correspond to one of the levels 1 through 3, a specialized process corresponding to the level 3 is carried out as a representative procedure. In this example, if a "rise" tone transition occurs when the flags of 2-bit correspond to the level 1 or the level 2, display quality improves compared to a normal process causing excess brightness, although response in many cases is insufficient.

The foregoing description discussed an example where a specialized process corresponding to the level 3 was designated as a representative process. Alternatively, a specialized process corresponding to another level may be designated as a representative process: for example, if designating a specialized process corresponding to the level 1 as a representative process does not cause excess brightness beyond an allowable range, a specialized process corresponding to the level 1 may be designated as a representative process.

Embodiment 14

Embodiments 1 to 13 described arrangements where to restrict excess brightness caused by unsuitable modulation in a normal process, the pixel PIX(i, j) which is unlikely to have dropped its brightness level sufficiently in a "decay" tone transition from the previous frame to the current frame is driven by a specialized process which facilitates tone transition less than a normal process.

In contrast, the present embodiment will describe an arrangement where the pixel PIX(i, j) which is unlikely to have increased its brightness level sufficiently in a "rise" tone transition from the previous frame to the current frame is driven by a specialized process which less facilitates tone transition than a normal process so as to prevent a shortcoming that the pixel PIX(i, j) appears inadequately dark from occurring when another shortcoming of unsuitable modulation occurs, that is, when the pixel PIX(i, j) has not sufficiently increased its brightness level in the rise tone transition from the tone before the previous tone to the current tone, and the next tone transition is a "rise".

The arrangement is applicable to any of the aforementioned embodiments by reversing polarity of "positive" and "negative" in a level determination and by reversing a ""decay"" and a ""rise"" in tone transition. The following will describe an arrangement applied to embodiment 12 as an example capable of performing both a specialized process to prevent inadequate brightness and a specialized process to prevent excess brightness.

In other words, in the present embodiment, at least one value of flags of multiple bits is assigned to a state where the brightness level has not risen sufficiently in the "rise" tone transition from the previous frame to the current frame, that is, a state where the tone transition does not sufficiently raised the brightness level.

Specifically, a flag generating circuit 25*n* provided in the modulated-drive processing section 11*n* of the present embodiment in place of the flag generating circuit 25*m* compares the video data D(i, j, k−1) for the current frame FR(k−1) with the video data D(i, j, k) for the desired frame FR(k), and stores a value indicating a "rise" as the flag F(i, j, k) for the desired frame FR(k) in the flag memory 26*k*, when the tone transition is a "rise".

The activation determination processing section 27 instructs the output signal generating circuit 24*k* to perform a specialized process, when (a) the flag F(i, j, k−1) stored in the flag memory 26*k* in the current frame FR(k−1) has a value indicating a "rise" and (b) the transition from the current tone to the desired tone is a "decay".

Figure 13:
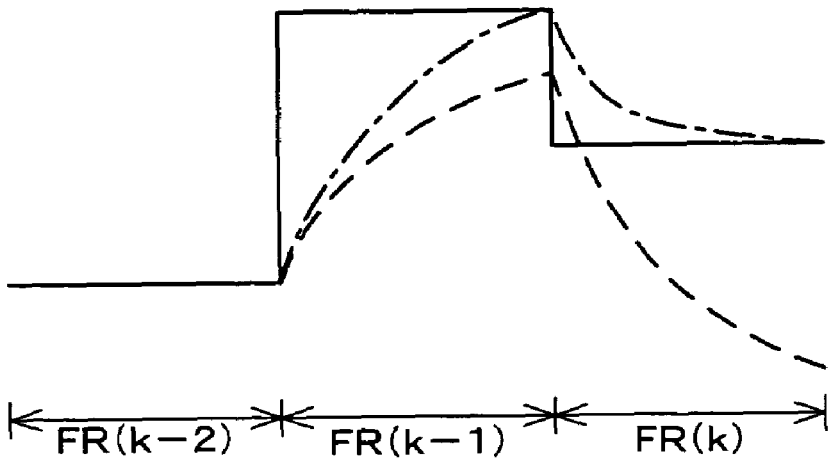
FIG. 13, illustrating conventional technology, is a timing chart showing an actually brightness level when transition from the previous tone through to the desired tone is a "rise" followed by a "decay".
Figure 14:
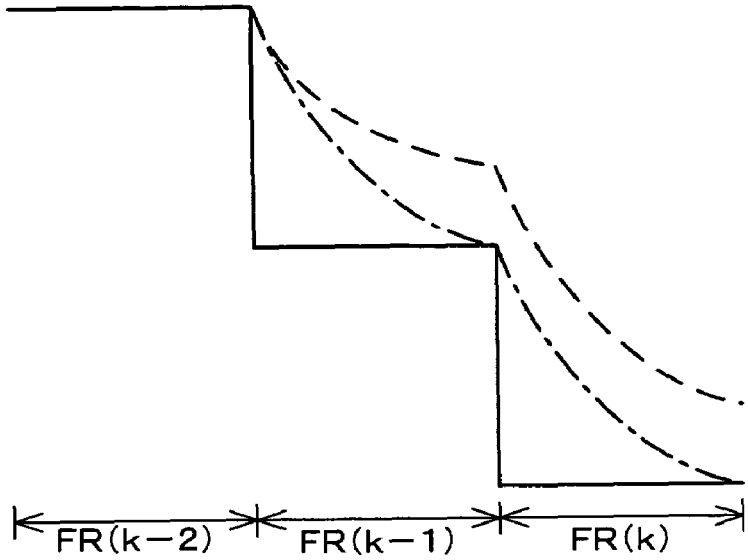
FIG. 14, illustrating conventional technology, is a timing chart showing an actually brightness level when transition from the previous tone through to the desired tone is a "decay" followed by a "decay".
Figure 15:
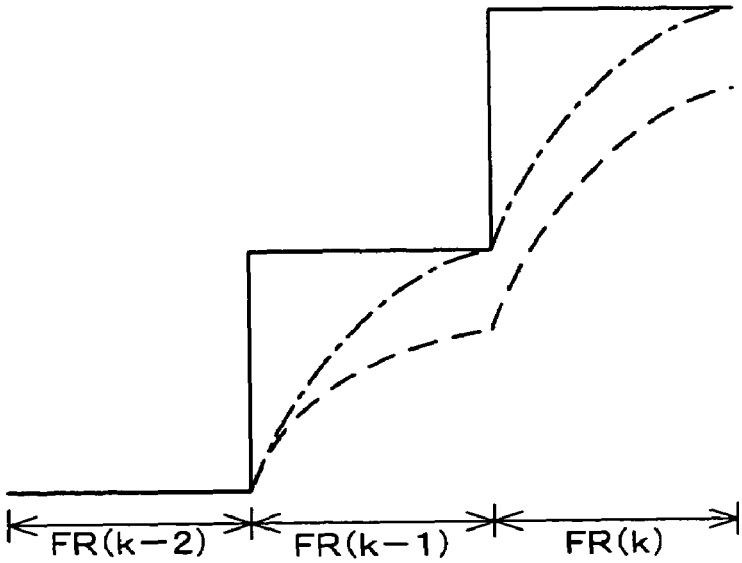
FIG. 15, illustrating conventional technology, is a timing chart showing an actually brightness level when transition from the previous tone through to the desired tone is a "rise" followed by a "rise".

According to the arrangement, when the transition from the previous tone through to the desired tone is a "rise" followed by a "decay", the pixel PIX(i, j) is driven by a specialized process which less facilitates tone transition than a normal process. Therefore, occurrence of inadequate brightness is prevented by the arrangement. The inadequate brightness of the pixel PIX(i, j) has conventionally occurred due to a "rise" as shown in FIG. 13 when (a) the transition from the previous tone through the current tone to the desired tone is a "rise" followed by a "decay" and (b) the pixel PIX(i, j) is driven by a normal process As a result, the brightness rapidly changes to the level indicated by the video data D(i, j, k) for the desired frame FR(k), using circuitry of a relatively small scale, while retaining good display quality of the pixel PIX(i, j).

Especially, in the present embodiment, the values of the flags other than that indicating a "rise" are assigned either to indicate that neither of the specialized processes are needed as in embodiment 12 or to indicate which of the specialized processes is, if at all, to be performed. Therefore, similarly to embodiment 12, excess brightness can be prevented from occurring, and the response speed is improved, using small-scale circuitry.

Embodiments 1 to 14 described video data being transferred field by field. Alternatively, the video data may be transferred frame by frame. Note that when video data is transferred field by field and the image display 1 performs a quasi-double speed process, a "rise" tone transition and a "decay" tone transition repeatedly occur at each edge between the two fields. The quasi-double speed process is, for example, the process in which a display of the image of each horizontal line constituting the desired field is copied to be a display of a horizontal line adjacent to the each horizontal line or in which interpolation, such as averaging, within a field ), or other processes. Therefore, especially great effects are obtained if the occurrence of excess brightness caused by tone transition which is a "decay" followed by a "rise" is restricted using any one of the arrangements of the embodiments.

Besides, the embodiments described a liquid crystal cell of vertical alignment mode and normally black mode being used as the display element as an example. This is not the only possibility. Substantially the same effects are obtainable with any display element which has a slow response speed and has a difference between actual tone transition and desired tone transition in the transition from the previous tone to the current tone even if the pixels are driven by tone transition facilitating modulation.

Note that a liquid crystal cell in vertical alignment mode and normally black mode has a response speed which is slower in a "decay" tone transition than in a "rise", and is likely to cause a difference between the actual tone transition and the desired tone transition in a "decay" tone transition from the previous frame to the current frame even if the pixel is driven by tone transition facilitating modulation. Therefore, especially great effects are obtained if the occurrence of excess brightness caused by tone transition which is a "decay" followed by a "rise" is restricted using any one of the arrangements of the embodiments.

Besides, FIG. 2 shows division into two periods T1 and T2. Alternatively, a frame may be divided into three or more periods. Note that when a frame is divided into two periods, the pixel is driven so that tone transition is facilitated in the first period T1, and thereafter, only a voltage is applied in accordance with the video data D(i, j, k) for the desired frame FR(k) in the next period T2. In this case, it is not necessary to refer to the flag F(i, j, k−1) to determine the necessity of a specialized process or to the video data D(i, j, k) for the current frame FR(k−1). Therefore, the storage region where the flag F(i, j, k−1) and/or the video data D(i, j, k) for the current frame FR(k−1) were stored can be assigned to store the flag F(i, j, k) and the video data D(i, j, k), for the desired frame FR(k), thereby reducing the storage capacity required with the modulated-drive processing section.

Further, the embodiments described, as an example, dividing a vertical period into multiple periods and applying a voltage V(i, j, k) varying in accordance with the video data D(i, j, k) for the desired frame FR(k) to the pixel PIX(i, j) in the last period. However, the division of a vertical period into multiple periods is not essential provided that a voltage V1(i, j, k) for which tone transition is facilitated can be applied to the pixel PIX(i, j).

For example, when a vertical period is divided into fields, the modulated-drive processing sections (11, 11*a*-11*n*) may cause the pixels PIX(i, j) to be driven so that the periods T1 and T2 are respective field periods in FIGS. 4, 5, 6, 8, 9, by, for example, controlling a signal applied to the control circuit 5. Besides, when a progressive signal is input to the modulated-drive processing section and when a frame period is equal to a vertical synchronization period, a voltage V1(i, j, k) for which tone transition is facilitated is continuously applied without period T2. In this case, since the circuit arrangement can be made relatively simple when compared to the pixel PIX(i, j) being driven with a period T2 provided, effects are greatest when it is required to make the driving simple.

The foregoing embodiments described a matrix image display (1) as an example. Alternatively, the image display may be of a line type. The embodiments are also applicable to displays driving a single display element. However, displays of line and matrix types (especially, the latter) tend to require a large frame memory capacity; it is not realistic to store video data for the previous frame even though display quality is improved through prevention of excess brightness. Therefore, especially great effects are achieved with line and matrix types (especially, the latter) if a drive method as in the foregoing embodiments is employed where display quality can be improved without adding much to circuit dimensions.

The foregoing embodiments described cases where the members constituting the modulated-drive processing section are all provided by hardware as an example. This is not however the only possibility. The members may be entirely or partly provided by a combination of a program embodying the aforementioned functions and hardware (computer) executing the program.

For example, a computer connected to the image display 1 may provide the function of the modulated-drive processing section (11-11*n*) as a device driver for use in driving the image display 1. Besides, when the modulated-drive processing section is provided in the form of a conversion board either built in or externally attached to the image display 1, and when the operation of the circuitry constituting the modulated-drive processing section can be altered by rewriting a program, such as, firmware, the circuitry may be operated as the modulated-drive processing section of the foregoing embodiments by distributing the program (software) which alters the operation of the circuitry.

In these cases, provided that hardware is prepared which is capable of executing the aforementioned functions, the modulated-drive processing section of the foregoing embodiments can be realized by only causing the hardware to execute the program.

The program can be offered to the user in the form of a computer-readable storage medium. The storage medium may be a built-in medium installed inside a computer main body or removable medium arranged so that it can be separated from the computer main body. Examples of the built-in medium include, but are not limited to, rewriteable involatile memories, such as ROMs and flash memories, and hard disks. Examples of the removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable involatile memory, such as memory cards; and media with a built-in ROM, such as ROM cassettes.

A method of driving a display in accordance with an embodiment of the present invention, as in the foregoing is a method of driving a display, may include:

(a) storing data indicating a drive signal for a desired time until a next time; and (b) modulating the drive signal for the desired time on the basis of data for a current time stored in the step (a) and the data indicating the drive signal for the desired time so as to facilitate a tone transition from the current time to the desired time;

and the method of driving a display may be arranged to include:

(c) comparing the data for the desired time with the data for the current time and storing a result of the comparison until the next time; and (d) adjusting a degree of modulation in the step (b) (degree by which the tone transition from the current time to the desired time is facilitated) with reference to a result of the comparison (of data for a previous time with the data for the current time) stored in the step (c) for the current time.

In the arrangement, the result of the comparison referenced in the modulation step for the desired time to adjust the degree of the modulation is a result of the comparison for the current frame, that is, the comparison of the data for the previous time with the data for the current time. Therefore, with reference to the comparison result, it can be determined with relatively high precision whether a situation has occurred in which the display's response speed is slow so that the tone transition from the previous time to the current time is insufficient. As a result, even if the above situation has occurred, that is, when modulating the drive signal to an ordinary degree (degree specified suitable for a case where tone transition from the previous time to the current time is sufficient) in the modulation step for the desired time it impossible to suitably drive the display, the degree of the modulation is adjusted to a degree in accordance with the situation.

According to the arrangement, a result of the comparison of the data for the previous time with the data for the current time, not the data itself indicating the drive signal for the previous time, is stored as information associated with a tone transition from the previous time to the current time. Thus, the degree of the modulation is adjustable in accordance with the situation. In addition thereto, storage capacity can be reduced which is required to store information associated with the tone transition from the previous time to the current time, as compared to a case where the data for the previous time is stored.

As a result, a display capable of adjusting the degree of the modulation and improving display quality even in accordance with a situation where modulating the drive signal to an ordinary degree (performing a normal process) makes impossible to suitably drive the display can be realized using circuitry of a relatively small scale.

A display typically repeatedly rewrites tone data at intervals. In a rewrite, a transition in tone as indicated by tone data is interpreted into a change in brightness of a pixel. In this specification, the "desired" or "second", "current" or "first", "previous," and "next" each refer to a period from a rewrite to a next rewrite (hereinafter, "rewrite period"): for example, a "frame period" or a "field period." The "desired" or "second" refers to a rewrite period including now. The "current" or "first" refers to the rewrite period immediately before the desired or second rewrite period. The "previous" refers to the rewrite period immediately before the current or first rewrite period. Finally, the "next" refers to the rewrite period immediately after the desired or second rewrite period. In addition, the "desired data" refers to the data on desired time, that is, the data indicating a drive signal supplied to the display during the desired time.

In addition to the arrangement, when it is determined on the basis of the data for the current time and the desired time that the tone transition from the current time to the desired time is insufficient, flag information instructing for a specialized process which reduces the degree of the modulation in the step (d) may be stored as the result of the comparison in the step (c).

According to the arrangement, when it is determined that the tone transition from the previous time to the current time is insufficient, the comparison result storing step for the current time stores flag information for an instruction for a specialized process. Therefore, the modulation step for the desired time can perform a specialized process which reduces the degree of modulation by which tone transition is facilitated. Therefore, even when the tone transition from the previous time to the current time in a single direction is insufficient, the occurrence of a shortcoming is prevented in which as a result of facilitating tone transition to an ordinary degree in the modulation step for the desired time, the tone transition in the other direction from the current time to the desired time is facilitated too much. Here, the user can spot degradation in display quality more easily when tone transition is facilitated too much than when tone transition is insufficient, that is, one can recognize that the display's response is delayed, because in the former case, a tone that actually should not appear is displayed.

In contrast, according to the present arrangement, excess facilitation of tone transition is prevented, and the display's display quality is maintained at a high level. Here, a "single direction" and the "other direction" in a tone transition refer to a tone rising direction or a tone falling direction.

With a normally black display, excess facilitation of tone transition in the modulation step causes excess brightness which is easily spotted by the user. Therefore, preventing the occurrence of excess brightness results in greatly improving the display's display quality.

In place of the step (c), when a level of a drive signal (second drive signal) indicated by the data for the desired time is lower than a level of a drive signal (first drive signal) indicated by the data for the current time, flag information instructing for a specialized process which reduces the degree of the modulation in the step (d) may be stored as the result of the comparison in the step (c).

According to the arrangement, flag information for an instruction for a specialized process is stored when tone transition tends to be insufficient (in a tone transition caused by a high-to-low level change of the drive signal) in a display which takes longer to change tone in response to a high-to-low level change of a modulated drive signal than in response to a low-to-high level change of a modulated drive signal. Therefore, when the tone transition from the previous time to the current time is such as described above, the adjusting step for the desired time reduces the degree of modulation in the modulation step. As a result, a shortcoming, that facilitation of the tone transition caused by a low-to-high level change of a drive signal is attempted but ends up in excess facilitation, is prevented from occurring in the modulation step for the desired time, thereby improving the display quality of the display.

In place of the step (c), when (1) a level of a drive signal indicated by the data for the desired time is lower than a level of a drive signal indicated by the data for the current time and (2) the level of the drive signal indicated by the data for the desired time is less than or equal to a predetermined value, flag information instructing for a specialized process which reduces the degree of the modulation in the step (d) may be stored as the result of the comparison in the step (c).

According to the arrangement, a shortcoming, that facilitation of the tone transition caused by a low-to-high level change of a drive signal is attempted but ends up in excess facilitation, is again prevented from occurring in the modulation step for the desired time, except for when the level of the drive signal for the current time is greater than a predetermined value. This is because the flag information stored in the comparison result storing step for the current time has the same arrangement as the aforementioned arrangement, that is, the flag information is determined only by magnitude relationship between the level of the drive signal for the previous time and the level of the drive signal for the current time.

Further, unlike the aforementioned arrangement, even when the level of the drive signal for the current time is greater than a predetermined value and the tone transition from the previous time to the current time is one that involves a high-to-low level change of a drive signal, no specialized process is performed if a sufficient tone transition is likely to have done. Therefore, a shortcoming is prevented from occurring that the response speed of the display is too slow if a specialized process is performed on top of sufficient tone transition despite the fact that the occurrence of excess facilitation shortcoming is preventable, and the display quality of the display can be improved.

In place of the step (c), when (1) a level of the drive signal indicated by the data for the desired time is lower than a level of the drive signal indicated by the data for the current time and (2) a difference between the two levels (the level of the drive signal indicated by the data for the current time and the level of the drive signal indicated by the data for the desired time) is more than or equal to a predetermined value, flag information instructing for a specialized process which reduces the degree of the modulation in the step (d) may be stored as the result of the comparison in the step (c).

According to the arrangement, the flag information stored in the comparison result storing step for the current time again has the same arrangement as the aforementioned arrangement, that is, the flag information is determined only by magnitude relationship between the level of the drive signal for the previous time and the level of the drive signal for the current time, except for when the difference between the levels is less than the predetermined value.

Further, unlike the aforementioned arrangement, even when the difference between the levels is smaller than the predetermined value, and the tone transition from the previous time to the current time is one that involves a high-to-low level change of a drive signal, no specialized process is performed if a sufficient tone transition is likely to have done. Therefore, a shortcoming is prevented from occurring that the response speed of the display is too slow if a specialized process is performed on top of sufficient tone transition despite the fact that the occurrence of excess facilitation shortcoming is preventable, and the display quality of the display can be improved.

Further, if only the magnitude relationship between the level of the drive signal for the previous time and the level of the drive signal for the current time is strictly determined when data for each time has substantially the same values (e.g., when it is practically safe to consider that a still image is being displayed if a specialized process is performed also when the difference between the two is less than the predetermined value), some pixels are driven by a normal process, whilst the others are driven by a specialized process. This causes irregularities in the display although the display is practically a still image. In contrast, in the aforementioned arrangement, no specialized process is performed when the difference between the two is less than the predetermined value; therefore, the occurrence of display irregularities is prevented, and the display quality of the display is improved.

In place of the step (c), when (1) a level of a drive signal indicated by the data for the desired time is lower than a level of a drive signal indicated by the data for the current time and (2) a difference between the two levels is more than or equal to a mean brightness level over a whole or a part of a displayed image, multiplied by a substantially constant value, flag information instructing for a specialized process which reduces the degree of the modulation in the step (d) may be stored as the result of the comparison in the step (c).

According to the arrangement, the flag information stored in the comparison result storing step for the current time again has the same arrangement as the aforementioned arrangement, that is, the flag information is determined only by magnitude relationship between the level of the drive signal for the previous time and the level of the drive signal for the current time, except for when the difference between the levels is less than the mean brightness level over a whole or a part of a displayed image, multiplied by a substantially constant value. Therefore, the occurrence of the excess facilitation shortcoming is prevented.

Further, unlike the aforementioned arrangement, because the ratio between the case when a specialized process is performed and the case when no specialized process is performed is specified in accordance with the mean brightness level over a whole or a part of a displayed image, the display area of pixels driven by a specialized process is limited so as not to exceed a predetermined proportion with respect to the display screen area of the display.

As a result, the specialized process prevents the excess facilitation shortcoming from occurring and improves the display quality of the display, without letting the user notice a shortcomings that the response speed of the pixels drops due to restrained tone transition facilitation by a specialized process.

In place of the step (c), when (1) a level of a drive signal indicated by the data for the desired time is lower than a level of a drive signal indicated by the data for the current time and (2) a difference between the data for the desired time and the data for the current time multiplied by a predetermined coefficient is more than or equal to a predetermined level, flag information instructing for a specialized process which reduces the degree of the modulation in the step (d) may be stored as the result of the comparison in the step (c).

According to the arrangement, the flag information stored in the comparison result storing step for the current time again has the same arrangement as the aforementioned arrangement, that is, the flag information is determined only by magnitude relationship between the level of the drive signal for the previous time and the level of the drive signal for the current time, except for when the difference between the data for the desired time and the data for the current time multiplied by a predetermined coefficient is less than a predetermined level. Therefore, the occurrence of the excess facilitation shortcoming can be prevented.

Further, unlike the aforementioned arrangement, although flag information for an instruction for a specialized process is stored for some of those pixels for which the level of the drive signal for the desired time is lower than the level of the drive signal for the current time, and not for the others, the lower level the drive signal for a pixel indicated by the data for the current time has, and the more likely the tone transition from the previous time to the current time of the pixel is insufficient, the more likely a specialized process is performed. Therefore, the occurrence of the excess facilitation shortcoming is efficiently prevented, and the display quality of the display is improved, without letting the user notice the aforementioned shortcoming that the response speed of the pixels drops due to the frequent performing of the specialized process.

On top of each arrangement, the degree of the modulation in the step (b) may be adjusted in the step (d) so that the drive signal for the desired time is not modulated to facilitate the tone transition from the current time to the desired time in response to an instruction for a specialized process.

According to the arrangement, in response to the instruction for a specialized process, the drive signal for the desired time is not modulated to facilitate the tone transition from the current time to the desired time. This ensures the prevention of the occurrence of an excess tone transition facilitation shortcoming. Besides, no circuit which sets the degree of the modulation to a mid-value is needed; therefore the circuit arrangement is simplified compared to when the degree is set to a mid-value.

In place of the step (d), the degree of the modulation in the step (b) may be adjusted in the step (d) so that the drive signal for the desired time is a mean drive signal of a drive signal corresponding to a case when the drive signal for the desired time is not modulated to facilitate the tone transition from the current time to the desired time and an unadjusted drive signal in response to an instruction for a specialized process. In other words, in place of the step (d), in response to the instruction for a specialized process, the step (d) may adjust the degree of the modulation in the step (b) so that the modulated drive signal for the desired time adjusted in the step (b) is a mean drive signal of the drive signal for the desired time before the modulation and the drive signal for the desired time after the modulation of an ordinary degree (degree suitably specified for a case when the tone transition from the previous time to the current time is sufficient), that is, unadjusted modulation, in the step (b).

The drive signals as voltage signals to be applied to the pixel may be averaged. Alternatively, rendering the tone data for generating voltage signals to be applied to the pixel, that is, the digital values indicating tone levels, as drive signals, the drive signals may be averaged. In this case, no additional circuitry is needed to generate signals weight-averaged with constant weights in accordance with an actual voltage. This simplifies the circuit arrangement and does not need to change the process even if a module is changed. The circuit implementing the adjusting step is thus applicable to a greater variety of modules.

According to the arrangement, when an instruction is made for a specialized process, a mean drive signal of the two drive signals is produced. Therefore, the greater the tone level excess amount due to excess modulation in response to excess tone transition facilitation, that is, the more likely the user will notice excess tone transition facilitation, the more the tone transition is restricted, thereby restraining excess tone transition facilitation. As a result, even in a specialized process, the response speed is improved, and the display quality of the display is improved, with the tone transition facilitated within such a range that excess tone transition facilitation does not occur. Since the drive signal has a mean value, the circuit arrangement is smaller or computation is less than a case where the drive signal is generated through another computation.

In place of the step (d), the degree of the modulation in the step (b) may be adjusted in the step (d) so that the drive signal for the desired time is a drive signal produced by weight-averaging, with predetermined weights, a drive signal corresponding to a case when the drive signal for the desired time is not modulated to facilitate the tone transition from the current time to the desired time and an unadjusted drive signal in response to an instruction for a specialized process. In this case, the drive signals as voltage signals to be applied to the pixel may be again averaged, similarly to the case where a mean value is taken. Alternatively, rendering the tone data for generating voltage signals to be applied to the pixel, that is, the digital values indicating the tone levels, as drive signals, the drive signals may be averaged.

According to the arrangement, an weight-averaged drive signal of the two drive signals is produced. Therefore, the greater the tone level excess amount due to excess modulation in response to excess tone transition facilitation, that is, the more likely the user will notice excess tone transition facilitation, the more the tone transition is restricted, thereby restraining excess tone transition facilitation. As a result, even in a specialized process, the response speed is improved, and the display quality of the display is improved, with the tone transition facilitated within such a range that excess tone transition facilitation does not occur.

On top of the arrangement, there may be further included the correction step of adjusting the weights in accordance with temperature. According to the arrangement, the weights are adjusted in accordance with temperature; therefore, even if the display device temperature is varied, the response speed is improved, and the display quality of the display is improved, with tone transition facilitated within such a range that excess tone transition facilitation does not occur in a specialized process.

On top of the arrangement, the correction step may further include the step of retrieving the weights in accordance with temperature from a pre-stored lookup table of weights corresponding to temperature information indicating temperatures.

According to the arrangement, weights in accordance with temperature are obtainable with reference to a lookup table; therefore, suitable weights are obtainable using small-scale circuitry even when the relationship between the temperature and the weights cannot be approximated with high precision using an expression which can be evaluated with a little computation.

On top of the arrangement, the drive method may further include the step of detecting the temperature using a temperature sensor mounted to the display. Thus, correction can be made in accordance with the display device temperature. Therefore, the response speed is improved, and the display quality of the display is improved, with the tone transition facilitated within such a range that excess tone transition facilitation does not occur in a specialized process for display quality.

On top of the arrangement, the step (b) may include the step of (f) modulating the drive signal for the desired time with reference to one of lookup tables, in which modulation information according to which the drive signal for the desired time is modulated and which corresponds to respective combinations of the data for the current time and the data for the desired time, is pre-stored; and in place of the step (d), the step (d) may include the step of selecting one of the lookup tables to be referenced in the step (f) in accordance with whether the instruction for the specialized process is made.

According to the arrangement, the process is switched between specialized and normal processes, depending on the selection of the lookup table. Modulation information in the specialized process which cannot be computed using an expression that can be evaluated with a little computation becomes obtainable using small-scale circuitry.

On top of the arrangement, when the flag information instructs for the specialized process, and a combination of the data for the current time and the data for the desired time is a predetermined combination, the step (d) may perform the specialized process.

According to the arrangement, even when flag information instructing for a specialized process is stored in the comparison result storing step for the current time, the specialized process is not performed unless the combination of the data for the current time and the data for the desired time is a predetermined combination. Therefore, a normal process is performed when the combination of the data for the current time and the data for the desired time is such that excess tone transition facilitation is unlikely to occur. As a result, in the foregoing case, the response speed of the display is improved, and the display quality of the display is improved.

On top of the arrangement, the step (d) may include the step of determining whether the combination of the data for the current time and the data for the desired time is the predetermined combination with reference to a lookup table in which information, which corresponds to respective combinations of the data for the current time and the data for the desired time and according to which it is determined whether the combination is the predetermined combination, is pre-stored.

According to the arrangement, it is determined whether the combination of the data for the current time and the data for the desired time is the predetermined combination with reference to a lookup table. The determination, which cannot be made at high precision using an expression that can be evaluated with a little computation, thereby becomes possible using small-scale circuitry.

Besides, the specialized process may be performed in the step (d) when flag information is stored which instructs for a specialized process if the level of the drive signal wholly or partly changes from a high state to a low state to cause a tone transition, when the flag information instructs for the specialized process, and the level of the drive signal indicated by the data for the desired time is lower than the level of the drive signal indicated by the data for the current time.

According to the arrangement, the specialized process is performed when (a) the tone transition from the previous time to the current time is one that involves a high-to-low level change of a drive signal and (b) the tone transition from the current time to the desired time is one that involves a change of a drive signal in the opposite direction. The tone transition from the current time to the desired time is thereby less facilitated. The specialized process can be performed when tone transition is facilitated too much if (a) the tone transition from the previous time to the current time is insufficient and (b) the drive signal for the desired time is modulated to an ordinary degree. As a result, excess tone transition facilitation can be prevented, and the display quality of the display is improved.

With a normally black display, excess facilitation of tone transition in the modulation step causes excess brightness which is easily spotted by the user. Therefore, preventing the occurrence of excess brightness results in greatly improving the display's display quality.

Besides, in place of the step (d), the specialized process may be performed in the step (d) when the flag information instructs for the specialized process, and the level of the drive signal indicated by the data for the current time is less than or equal to a predetermined level.

According to the arrangement, a normal process is performed when the level of the drive signal indicated by the data for the current time is higher than a predetermined level even if the tone transition from the previous time to the current time is one that involves a high-to-low level change of a drive signal, that is, when the tone transition from the previous time to the current time is likely to be sufficient; therefore, excess tone transition facilitation is prevented, and the display quality of the display is also improved. Further, decreases in the response speed of the display due to frequent facilitation processes is prevented.

On top of the arrangement, a specialized process at multiple levels which reduce the degree of the modulation differently from one another is performed as the specialized process in the step (d); the flag information may be at least two bits; and when flag information instructing for a specialized process is stored, flag information indicating one of the levels with which the specialized process is to be performed is stored in the step (c).

According to the arrangement, a specialized process including multiple levels is selectable; therefore, the tone transition from the current time to the desired time is facilitated even in a specialized process at a suitable level in accordance with the tone transition from the previous time to the current time. Therefore, even in a specialized process, the response speed is improved, and the display quality of the display is improved, with the tone transition facilitated within such a range that excess tone transition facilitation does not occur.

On top of the arrangement, the step (g) of determining whether a displayed image is a still image may be further included, wherein when flag information instructing for a specialized process at one of the levels may have been stored in the step (c) for the current time, flag information indicating a higher level at which tone transition is facilitated is stored as a result of comparison for the desired time in the step (c) for the desired time (the degree of the modulation is greater).

According to the arrangement, a specialized process is performed with a lower level than when there is no still image state, that is, with such a high level that the tone transition is less facilitated, when the first tone transition and the subsequent second tone transition produce in combination such a tone transition that a specialized process should be performed unless there is a still image state between the transitions. Therefore, excess tone transition facilitation is prevented, and the display quality of the display is improved, even when a still image is to be displayed on a display with such a slow response speed that the first tone transition is substantially insufficient.

On top of the arrangement, the step (g) of determining whether a displayed image is a still image may be further included, wherein when flag information instructing for a specialized process at one of the levels has been stored in the step (c) for the current time, and it is determined that the image is a still image in the step (g), flag information indicating a higher level at which tone transition is facilitated is stored as a result of comparison for the desired time in the step (c) for the desired time (the degree of the modulation is greater).

According to the arrangement, a specialized process is performed with a lower level, that is, with such a high level that the tone transition is less facilitated than when there is no still image state, when the first tone transition and the subsequent second tone transition produce in combination such a tone transition that a specialized process should be performed unless there is a still image state between the transitions. Therefore, excess tone transition facilitation is prevented, and the display quality of the display is improved, even when a still image is to be displayed on a display with such a slow response speed that the first tone transition is substantially insufficient.

Besides, when (1) a level of a drive signal indicated by the data for the desired time is higher than a level of a drive signal indicated by the data for the current time, and (2) it is determined that the tone transition from the current time to the desired time is insufficient on the basis of both data, flag information instructing for a specialized process which reduces the degree of the modulation in the step (d) may be stored as the result of the comparison in the step (c).

According to the arrangement, a specialized process is performed when (a) the tone transition from the previous time to the current time is one that the drive signal becomes great and (b) it is determined that the tone transition is insufficient. Therefore, even when the tone transition from the current time to the desired time is in a direction opposite to the tone transition, the display quality of the display is improved without excess tone transition facilitation.

With a normally black display, when (a) the tone transition from the previous time to the current time is one that the level of the drive signal becomes great and (b) the tone transition from the current time to the desired time is in a direction opposite to the tone transition, inadequate brightness occurs. The inadequate brightness is however less recognizable to the user than the excess brightness that occurs when the tone transition from the previous time to the current time is one that involves a drop in the level of the drive signal, and the tone transition from the current time to the desired time is in a direction opposite to the tone transition.

Therefore, when flag information is stored for an instruction for a specialized process in a case where (a) the tone transition is one that the level of the drive signal becomes great and (b) it is determined that the tone transition is insufficient, it is preferred to store information instructing for a specialized process as remaining flag information, wholly or partly, when the level of the drive signal drops.

On top of the arrangement, the display may include a liquid crystal display element of vertical alignment mode and normally black mode as a display element. Under these circumstances, a liquid crystal display element of vertical alignment mode and normally black mode is suitably applicable to each of the foregoing arrangements, because such a display tends to produce insufficient tone transition when the tone transition involves a drop in the drive signal level.

In preferred embodiments of the method of driving a display in accordance with the present invention, the desired time refers to a desired frame period; the next time refers to a frame period immediately after the desired frame; the current time refers to a frame period immediately before the desired frame period; and the previous time refers to a frame period before the current frame period.

The frame period is a rewrite time corresponding to a frame frequency: typically, a rewrite time of 16.7 msec corresponding to an ordinary frame frequency of 60 Hz.

A display in accordance with an embodiment of the present invention may include, as in the foregoing: memory means for storing data indicating a drive signal for a desired time until a next time; and modulation means for modulating the drive signal for the desired time on the basis of data for a current time stored in the memory means and the data indicating the drive signal for the desired time so as to facilitate a tone transition from the current time to the desired time; comparison result memory means for comparing the data for the desired time with the data for the current time and, for storing a result of the comparison until the next time; and adjusting means for adjusting a degree of modulation by the modulation means with reference to a result of the comparison for the current frame stored in the comparison result memory means (the comparison of data for a previous time with the data for the current time).

The display having the arrangement can be driven by the aforementioned method of driving a display. Therefore, even in a situation where the display is not suitably driven if the drive signal is modulated to an ordinary degree as in the method of driving a display, a display capable of adjusting the degree of the modulation in accordance with the situation and improving display quality is realized using circuitry of a relatively small scale.

A drive signal processor in accordance with an embodiment of the present invention may be, as in the foregoing, a drive signal processor for processing a display drive signal, and is arranged so as to include: memory means for storing data indicating a drive signal for a desired time until a next time; modulation means for modulating the drive signal for the desired time on the basis of data for a current time stored in the memory means and the data indicating the drive signal for the desired time so as to facilitate a tone transition from the current time to the desired time; comparison result memory means for comparing the data for the desired time with the data for the current time, and for storing a result of the comparison until the next time; and adjusting means for adjusting a degree of modulation by the modulation means with reference to a result of the comparison of data for a previous time with the data for the current time stored in the comparison result memory means for the current time.

The drive signal processor having the arrangement can process the drive signal which can realize the aforementioned method of driving a display. Therefore, even in a situation where the display is not suitably driven if the drive signal is modulated to an ordinary degree as in the method of driving a display, a display capable of adjusting the degree of the modulation in accordance with the situation and improving display quality is realized using circuitry of a relatively small scale.

A program in accordance with an embodiment of the present invention is a program causing a computer to execute the respective steps. Therefore, when the program is executed on a computer, the computer drives the display by the drive method. As a result, even in a situation where the display is not suitably driven if the drive signal is modulated to an ordinary degree as in the method of driving a display, a display capable of adjusting the degree of the modulation in accordance with the situation and improving display quality is realized using circuitry of a relatively small scale.

A storage medium in accordance with an embodiment of the present invention is a computer-readable storage medium on which the program is recorded. Therefore, when the program stored on the storage medium is loaded and run on a computer, the computer drives the display by the aforementioned drive method. As a result, even in a situation where the display is not suitably driven if the drive signal is modulated to an ordinary degree as in the method of driving a display, a display capable of adjusting the degree of the modulation in accordance with the situation and improving display quality is realized using circuitry of a relatively small scale.

The embodiments and examples described are for illustrative purposes only and by no means limit the scope of the present invention. Variations are not to be regarded as a departure from the spirit and scope of the invention, and all such modifications as would be obvious to one skilled in the art are intended to be included within the scope of the claims below.

What is claimed is:

1. A method of driving a display, comprising:

storing data corresponding to a drive signal input at a first time;

changing a voltage level of a drive signal input at a second time, subsequent to the first time, based upon the stored data so as to accelerate a tone transition from the first time to the second time; and comparing data corresponding to the drive signal input at the first time and data input at a time previous to the first time, wherein a degree of the change is adjustable prior to changing, with reference to the result of the comparison.

2. The method of driving a display as set forth in claim 1, wherein when it is determined, on the basis of the drive signal input at the first time and the drive signal input at the second time that the tone transition from the first time to the second time is insufficient, the degree of change is reduced.

3. The method of driving a display as set forth in claim 2, wherein the degree of the change is adjusted such that the drive signal input at the second time is not changed, to accelerate the tone transition from the first time to the second time, in response to the determination being made.

4. The method of driving a display as set forth in claim 2, wherein the degree of the change is adjusted such that the drive signal input at the second time is a mean drive signal of a drive signal, corresponding to a case when the drive signal input at the second time is not changed to accelerate the tone transition from the first time to the second time, and of an unadjusted drive signal, in response to the determination being made.

5. The method of driving a display as set forth in claim 2, wherein the degree of the change is adjusted such that the drive signal input at the second time is a drive signal produced by weight-averaging, with predetermined weights, a drive signal corresponding to a case when the drive signal input at the second time is not modulated to facilitate the tone transition from the first time to the second time and an unadjusted drive signal, in response to the determination being made.

6. The method of driving a display as set forth in claim 5, further comprising:

adjusting the weights in accordance with temperature.

7. The method of driving a display as set forth in claim 6, wherein the step of adjusting the weights includes retrieving weights that vary in accordance with temperature from a lookup table, in which the weights corresponding to temperature information indicating temperatures are pre-stored.

8. The method of driving a display as set forth in claim 6, further comprising:

detecting the temperature using a temperature sensor mounted to the display.

9. The method of driving a display as set forth in claim 2, wherein:

the step of changing includes changing the voltage level of the drive signal input at the second time with reference to one of a plurality of lookup tables, in which change information, according to which the voltage level of the drive signal input at the second time is changed and which corresponds to respective combinations of the drive signal input at the first time and the drive signal input at the second time, is pre-stored; and wherein adjustability of the change includes selecting one of the lookup tables to be referenced in accordance with whether the determination is made.

10. The method of driving a display as set forth in claim 2, wherein flag information is stored when the determination is made, instructing a process which reduces the degree of the change.

11. The method of driving a display as set forth in claim 10, wherein when the flag information instructs the process, and a combination of the drive signal input at the first time and the drive signal input at the second time is a predetermined combination, the change adjustment is performed.

12. The method of driving a display as set forth in claim 10, wherein:

a specialized process at multiple discrete levels, which reduce the degree of the change differently from one another, is performed as the process;

the flag information is expressed by at least two bits; and when flag information instructing for a process is stored, flag information indicating one of the levels with which the process is to be performed is stored.

13. The method of driving a display as set forth in claim 12, further comprising the step of:

determining whether a displayed image is a still image, wherein when flag information instructing for a process at one of the levels has been stored for the drive signal input at the first time, flag information indicating a relatively higher level at which tone transition is accelerated is stored as a result of comparison for the drive signal input at the second time.

14. The method of driving a display as set forth in claim 12, further comprising the step of:

determining whether a displayed image is a still image, wherein when flag information instructing for a process at one of the levels has been stored for the drive signal input at the first time, and when it is determined that the image is a still image, flag information indicating a relatively higher level at which tone transition is accelerated is stored as a result of comparison for the drive signal input at the second time.

15. The method of driving a display as set forth in claim 11, wherein the change adjustment includes determining whether the combination of the drive signal at the first time and the drive signal at the second time is the predetermined combination with reference to a lookup table in which information, corresponding to respective combinations of the drive signal at the first time and the drive signal at the second time, and according to which a determination is made as to whether the combination is the predetermined combination, is pre-stored.

16. The method of driving a display as set forth in claim 1, wherein when a level of the second drive signal input at the second time is lower than a level of the first drive signal input at the first time, a condition is met and the degree of change is reduced.

17. The method of driving a display as set forth in claim 16, wherein flag information is stored when the condition is met, instructing a process which reduces the degree of the change.

18. The method of driving a display as set forth in claim 16, wherein the degree of the change is adjusted such that the drive signal input at the second time is not changed, to accelerate the tone transition from the first time to the second time, in response to the condition being met.

19. The method of driving a display as set forth in claim 16, wherein the degree of the change is adjusted in the step so that the drive signal input at the second time is a mean drive signal of a drive signal, corresponding to a case when the drive signal input at the second time is not changed to accelerate the tone transition from the first time to the second time, and an unadjusted drive signal, in response to the condition being met.

20. The method of driving a display as set forth in claim 16, wherein the degree of the change is adjusted such that the drive signal input at the second time is a drive signal produced by weight-averaging, with predetermined weights, a drive signal corresponding to a case when the drive signal input at the second time is not changed to accelerate the tone transition from the first time to the second time and an unadjusted drive signal, in response to the condition being met.

21. The method of driving a display as set forth in claim 20, further comprising:

adjusting the weights in accordance with temperature.

22. The method of driving a display as set forth in claim 21, wherein the step of adjusting the weights includes retrieving weights that vary in accordance with temperature from a lookup table, in which the weights corresponding to temperature information indicating temperatures are pre-stored.

23. The method of driving a display as set forth in claim 21, further comprising:

detecting the temperature using a temperature sensor mounted to the display.

24. The method of driving a display as set forth in claim 16, wherein:

the step of changing includes changing the voltage level of the drive signal input at the second time with reference to one of a plurality of lookup tables, in which change information, according to which the voltage level of the drive signal input at the second time is changed and which corresponds to respective combinations of the drive signal input at the first time and the drive signal input at the second time, is pre-stored; and wherein adjustability of the change includes selecting one of the lookup tables to be referenced in accordance with whether the condition is met.

25. The method of driving a display as set forth in claim 17, wherein when the flag information instructs the process, and a combination of the drive signal input at the first time and the drive signal input at the second time is a predetermined combination, the change adjustment is performed.

26. The method of driving a display as set forth in claim 25, wherein the change adjustment includes determining whether the combination of the drive signal at the first time and the drive signal at the second time is the predetermined combination with reference to a lookup table in which information, corresponding to respective combinations of the drive signal at the first time and the drive signal at the second time, and according to which a determination is made as to whether the combination is the predetermined combination, is pre-stored.

27. The method of driving a display as set forth in claim 17, wherein the process is performed when the flag information instructs the process, and when the level of the second drive signal is lower than the level of the first drive signal.

28. The method of driving a display as set forth in claim 17, wherein:

a specialized process at multiple discrete levels, which reduce the degree of the change differently from one another, is performed as the process;

the flag information is expressed by at least two bits; and when flag information instructing for a process is stored, flag information indicating one of the levels with which the process is to be performed is stored.

29. The method of driving a display as set forth in claim 28, further comprising the step of:

determining whether a displayed image is a still image, wherein when flag information instructing for a process at one of the levels has been stored for the drive signal input at the first time, flag information indicating a relatively higher level at which tone transition is accelerated is stored as a result of comparison for the drive signal input at the second time.

30. The method of driving a display as set forth in claim 28, further comprising the step of:

determining whether a displayed image is a still image, wherein when flag information instructing for a process at one of the levels has been stored for the drive signal input at the first time, and when it is determined that the image is a still image, flag information indicating a relatively higher level at which tone transition is accelerated is stored as a result of comparison for the drive signal input at the second time.

31. The method of driving a display as set forth in claim 1, wherein when a level of the second drive signal input at the second time is lower than a level of the first drive signal input at the first time and when the level of the second drive signal indicated by the drive signal input at the second time is at most equal to a predetermined value, a condition is met and the degree of change is reduced.

32. The method of driving a display as set forth in claim 31, wherein flag information is stored when the condition is met, instructing a process which reduces the degree of the change.

33. The method of driving a display as set forth in claim 31, wherein the degree of the change is adjusted such that the drive signal input at the second time is not changed, to accelerate the tone transition from the first time to the second time, in response to the condition being met.

34. The method of driving a display as set forth in claim 31, wherein the degree of the change is adjusted in the step so that the drive signal input at the second time is a mean drive signal of a drive signal, corresponding to a case when the drive signal input at the second time is not changed to accelerate the tone transition from the first time to the second time, and an unadjusted drive signal, in response to the condition being met.

35. The method of driving a display as set forth in claim 31, wherein the degree of the change is adjusted such that the drive signal input at the second time is a drive signal produced by weight-averaging, with predetermined weights, a drive signal corresponding to a case when the drive signal input at the second time is not changed to accelerate the tone transition from the first time to the second time and an unadjusted drive signal, in response to the condition being met.

36. The method of driving a display as set forth in claim 35, further comprising:

adjusting the weights in accordance with temperature.

37. The method of driving a display as set forth in claim 36, wherein the step of adjusting the weights includes retrieving weights that vary in accordance with temperature from a lookup table, in which the weights corresponding to temperature information indicating temperatures are pre-stored.

38. The method of driving a display as set forth in claim 36, further comprising:

detecting the temperature using a temperature sensor mounted to the display.

39. The method of driving a display as set forth in claim 31, wherein:

the step of changing includes changing the voltage level of the drive signal input at the second time with reference to one of a plurality of lookup tables, in which change information, according to which the voltage level of the drive signal input at the second time is changed and which corresponds to respective combinations of the drive signal input at the first time and the drive signal input at the second time, is pre-stored; and wherein adjustability of the change includes selecting one of the lookup tables to be referenced in accordance with whether the condition is met.

40. The method of driving a display as set forth in claim 32, wherein when the flag information instructs the process, and a combination of the drive signal input at the first time and the drive signal input at the second time is a predetermined combination, the change adjustment is performed.

41. The method of driving a display as set forth in claim 40, wherein the change adjustment includes determining whether the combination of the drive signal at the first time and the drive signal at the second time is the predetermined combination with reference to a lookup table in which information, corresponding to respective combinations of the drive signal at the first time and the drive signal at the second time, and according to which a determination is made as to whether the combination is the predetermined combination, is pre-stored.

42. The method of driving a display as set forth in claim 32, wherein the process is performed when the flag information instructs the process, and when the level of the second drive signal is lower than the level of the first drive signal.

43. The method of driving a display as set forth in claim 32, wherein:

a specialized process at multiple discrete levels, which reduce the degree of the change differently from one another, is performed as the process;

the flag information is expressed by at least two bits; and when flag information instructing for a process is stored, flag information indicating one of the levels with which the process is to be performed is stored.

44. The method of driving a display as set forth in claim 43, further comprising the step of:

determining whether a displayed image is a still image, wherein when flag information instructing for a process at one of the levels has been stored for the drive signal input at the first time, flag information indicating a relatively higher level at which tone transition is accelerated is stored as a result of comparison for the drive signal input at the second time.

45. The method of driving a display as set forth in claim 43, further comprising the step of:

determining whether a displayed image is a still image, wherein when flag information instructing for a process at one of the levels has been stored for the drive signal input at the first time, and when it is determined that the image is a still image, flag information indicating a relatively higher level at which tone transition is accelerated is stored as a result of comparison for the drive signal input at the second time.

46. The method of driving a display as set forth in claim 1, wherein when a level of the second drive signal input at the second time is lower than a level of the first drive signal input at the first time and when a difference between the level of the first drive signal and the level of the second drive signal is at least equal to a predetermined value, a condition is met and the degree of change is reduced.

47. The method of driving a display as set forth in claim 46, wherein flag information is stored when the condition is met, instructing a process which reduces the degree of the change.

48. The method of driving a display as set forth in claim 46, wherein the degree of the change is adjusted such that the drive signal input at the second time is not changed, to accelerate the tone transition from the first time to the second time, in response to the condition being met.

49. The method of driving a display as set forth in claim 46, wherein the degree of the change is adjusted in the step so that the drive signal input at the second time is a mean drive signal of a drive signal, corresponding to a case when the drive signal input at the second time is not changed to accelerate the tone transition from the first time to the second time, and an unadjusted drive signal, in response to the condition being met.

50. The method of driving a display as set forth in claim 46, wherein the degree of the change is adjusted such that the drive signal input at the second time is a drive signal produced by weight-averaging, with predetermined weights, a drive signal corresponding to a case when the drive signal input at the second time is not changed to accelerate the tone transition from the first time to the second time and an unadjusted drive signal, in response to the condition being met.

51. The method of driving a display as set forth in claim 50, further comprising:

adjusting the weights in accordance with temperature.

52. The method of driving a display as set forth in claim 51, wherein the step of adjusting the weights includes retrieving weights that vary in accordance with temperature from a lookup table, in which the weights corresponding to temperature information indicating temperatures are pre-stored.

53. The method of driving a display as set forth in claim 51, further comprising:

detecting the temperature using a temperature sensor mounted to the display.

54. The method of driving a display as set forth in claim 46, wherein:

the step of changing includes changing the voltage level of the drive signal input at the second time with reference to one of a plurality of lookup tables, in which change information, according to which the voltage level of the drive signal input at the second time is changed and which corresponds to respective combinations of the drive signal input at the first time and the drive signal input at the second time, is pre-stored; and wherein adjustability of the change includes selecting one of the lookup tables to be referenced in accordance with whether the condition is met.

55. The method of driving a display as set forth in claim 47, wherein when the flag information instructs the process, and a combination of the drive signal input at the first time and the drive signal input at the second time is a predetermined combination, the change adjustment is performed.

56. The method of driving a display as set forth in claim 55, wherein the change adjustment includes determining whether the combination of the drive signal at the first time and the drive signal at the second time is the predetermined combination with reference to a lookup table in which information, corresponding to respective combinations of the drive signal at the first time and the drive signal at the second time, and according to which a determination is made as to whether the combination is the predetermined combination, is pre-stored.

57. The method of driving a display as set forth in claim 47, wherein the process is performed when the flag information instructs the process, and when the level of the second drive signal is lower than the level of the first drive signal.

58. The method of driving a display as set forth in claim 47, wherein:

a specialized process at multiple discrete levels, which reduce the degree of the change differently from one another, is performed as the process;

the flag information is expressed by at least two bits; and when flag information instructing for a process is stored, flag information indicating one of the levels with which the process is to be performed is stored.

59. The method of driving a display as set forth in claim 58, further comprising the step of:

determining whether a displayed image is a still image, wherein when flag information instructing for a process at one of the levels has been stored for the drive signal input at the first time, flag information indicating a relatively higher level at which tone transition is accelerated is stored as a result of comparison for the drive signal input at the second time.

60. The method of driving a display as set forth in claim 58, further comprising the step of:

determining whether a displayed image is a still image, wherein when flag information instructing for a process at one of the levels has been stored for the drive signal input at the first time, and when it is determined that the image is a still image, flag information indicating a relatively higher level at which tone transition is accelerated is stored as a result of comparison for the drive signal input at the second time.

61. The method of driving a display as set forth in claim 1, wherein when a level of the second drive signal input at the second time is lower than a level of the first drive signal input at the first time and when a difference between the level of the first drive signal and the level of the second drive signal is at least equal to a mean brightness level over at least a part of a displayed image, multiplied by a substantially constant value, a condition is met and the degree of change is reduced.

62. The method of driving a display as set forth in claim 61, wherein flag information is stored when the condition is met, instructing a process which reduces the degree of the change.

63. The method of driving a display as set forth in claim 61, wherein the degree of the change is adjusted such that the drive signal input at the second time is not changed, to the tone transition from the first time to the second time, in response to the condition being met.

64. The method of driving a display as set forth in claim 61, wherein the degree of the change is adjusted in the step so that the drive signal input at the second time is a mean drive signal of a drive signal, corresponding to a case when the drive signal input at the second time is not changed to accelerate the tone transition from the first time to the second time, and an unadjusted drive signal, in response to the condition being met.

65. The method of driving a display as set forth in claim 61, wherein the degree of the change is adjusted such that the drive signal input at the second time is a drive signal produced by weight-averaging, with predetermined weights, a drive signal corresponding to a case when the drive signal input at the second time is not changed to accelerate the tone transition from the first time to the second time and an unadjusted drive signal, in response to the condition being met.

66. The method of driving a display as set forth in claim 65, further comprising:

adjusting the weights in accordance with temperature.

67. The method of driving a display as set forth in claim 66, wherein the step of adjusting the weights includes retrieving weights that vary in accordance with temperature from a lookup table, in which the weights corresponding to temperature information indicating temperatures are pre-stored.

68. The method of driving a display as set forth in claim 66, further comprising:

detecting the temperature using a temperature sensor mounted to the display.

69. The method of driving a display as set forth in claim 61, wherein:

the step of changing includes changing the voltage level of the drive signal input at the second time with reference to one of a plurality of lookup tables, in which change information, according to which the voltage level of the drive signal input at the second time is changed and which corresponds to respective combinations of the drive signal input at the first time and the drive signal input at the second time, is pre-stored; and wherein adjustability of the change includes selecting one of the lookup tables to be referenced in accordance with whether the condition is met.

70. The method of driving a display as set forth in claim 62, wherein when the flag information instructs the process, and a combination of the drive signal input at the first time and the drive signal input at the second time is a predetermined combination, the change adjustment is performed.

71. The method of driving a display as set forth in claim 70, wherein the change adjustment includes determining whether the combination of the drive signal at the first time and the drive signal at the second time is the predetermined combination with reference to a lookup table in which information, corresponding to respective combinations of the drive signal at the first time and the drive signal at the second time, and according to which a determination is made as to whether the combination is the predetermined combination, is pre-stored.

72. The method of driving a display as set forth in claim 62, wherein the process is performed when the flag information instructs the process, and when the level of the second drive signal is lower than the level of the first drive signal.

73. The method of driving a display as set forth in claim 62, wherein:

a specialized process at multiple discrete levels, which reduce the degree of the change differently from one another, is performed as the process;

the flag information is expressed by at least two bits; and when flag information instructing for a process is stored, flag information indicating one of the levels with which the process is to be performed is stored.

74. The method of driving a display as set forth in claim 73, further comprising the step of:

determining whether a displayed image is a still image, wherein when flag information instructing for a process at one of the levels has been stored for the drive signal input at the first time, flag information indicating a relatively higher level at which tone transition is accelerated is stored as a result of comparison for the drive signal input at the second time.

75. The method of driving a display as set forth in claim 73, further comprising the step of:

determining whether a displayed image is a still image, wherein when flag information instructing for a process at one of the levels has been stored for the drive signal input at the first time, and when it is determined that the image is a still image, flag information indicating a relatively higher level at which tone transition is accelerated is stored as a result of comparison for the drive signal input at the second time.

76. The method of driving a display as set forth in claim 1, wherein when a level of the second drive signal input at the second time is lower than a level of the first drive signal input at the first time and when a difference between the level of the second drive signal and the level of the first drive signal multiplied by a predetermined coefficient is at least equal to a predetermined level, a condition is met and the degree of change is reduced.

77. The method of driving a display as set forth in claim 76, wherein flag information is stored when the condition is met, instructing a process which reduces the degree of the change.

78. The method of driving a display as set forth in claim 76, wherein the degree of the change is adjusted such that the drive signal input at the second time is not changed, to accelerate the tone transition from the current time to the desired time, in response to the condition being met.

79. The method of driving a display as set forth in claim 76, wherein the degree of the change is adjusted in the step so that the drive signal input at the second time is a mean drive signal of a drive signal, corresponding to a case when the drive signal input at the second time is not changed to accelerate the tone transition from the first time to the second time, and an unadjusted drive signal, in response to the condition being met.

80. The method of driving a display as set forth in claim 76, wherein the degree of the change is adjusted such that the drive signal input at the second time is a drive signal produced by weight-averaging, with predetermined weights, a drive signal corresponding to a case when the drive signal input at the second time is not changed to accelerate the tone transition from the first time to the second time and an unadjusted drive signal, in response to the condition being met.

81. The method of driving a display as set forth in claim 80, further comprising:

adjusting the weights in accordance with temperature.

82. The method of driving a display as set forth in claim 81, wherein the step of adjusting the weights includes retrieving weights that vary in accordance with temperature from a lookup table, in which the weights corresponding to temperature information indicating temperatures are pre-stored.

83. The method of driving a display as set forth in claim 81, further comprising:

detecting the temperature using a temperature sensor mounted to the display.

84. The method of driving a display as set forth in claim 76, wherein:

the step of changing includes changing the voltage level of the drive signal input at the second time with reference to one of a plurality of lookup tables, in which change information, according to which the voltage level of the drive signal input at the second time is changed and which corresponds to respective combinations of the drive signal input at the first time and the drive signal input at the second time, is pre-stored; and wherein adjustability of the change includes selecting one of the lookup tables to be referenced in accordance with whether the condition is met.

85. The method of driving a display as set forth in claim 77, wherein when the flag information instructs the process, and a combination of the drive signal input at the first time and the drive signal input at the second time is a predetermined combination, the change adjustment is performed.

86. The method of driving a display as set forth in claim 85, wherein the change adjustment includes determining whether the combination of the drive signal at the first time and the drive signal at the second time is the predetermined combination with reference to a lookup table in which information, corresponding to respective combinations of the drive signal at the first time and the drive signal at the second time, and according to which a determination is made as to whether the combination is the predetermined combination, is pre-stored.

87. The method of driving a display as set forth in claim 77, wherein the process is performed when the flag information instructs the process, and when the level of the second drive signal is lower than the level of the first drive signal.

88. The method of driving a display as set forth in claim 77, wherein:

a specialized process at multiple discrete levels, which reduce the degree of the change differently from one another, is performed as the process;

the flag information is expressed by at least two bits; and when flag information instructing for a process is stored, flag information indicating one of the levels with which the process is to be performed is stored.

89. The method of driving a display as set forth in claim 88, further comprising the step of:

determining whether a displayed image is a still image, wherein when flag information instructing for a process at one of the levels has been stored for the drive signal input at the first time, flag information indicating a relatively higher level at which tone transition is accelerated is stored as a result of comparison for the drive signal input at the second time.

90. The method of driving a display as set forth in claim 88, further comprising the step of:

determining whether a displayed image is a still image, wherein when flag information instructing for a process at one of the levels has been stored for the drive signal input at the first time, and when it is determined that the image is a still image, flag information indicating a relatively higher level at which tone transition is accelerated is stored as a result of comparison for the drive signal input at the second time.

91. The method of driving a display as set forth in claim 1, wherein when a level of a second drive signal input at a second time is relatively higher than a level of a first drive signal input at a first time and when it is determined that the tone transition from the first time to the second time is insufficient on the basis of both drive signals, flag information instructing a process which reduces the degree of the change is stored as the result of the comparison.

92. The method of driving a display as set forth in claim 1, wherein the display includes a liquid crystal display element of normally black mode as a display element.

93. The method of driving a display as set forth in claim 1, wherein the display includes a liquid crystal display element of vertical alignment mode and normally black mode as a display element.

94. The method of driving a display as set forth in claim 1, wherein:

the second time corresponds to a second frame period;

the first time corresponds to a frame period immediately before the second frame period; and the previous time corresponds to a frame period before the first frame period.

95. A display, comprising:

memory means for storing data of a drive signal input at a first time;

change means for changing a voltage level of a drive signal input at a second time, subsequent to the first time, based upon the stored data so as to accelerate a tone transition from the first time to the second time;

comparison result memory means for storing a result of a comparison of the stored data corresponding to the drive signal input at the first time and data input at a time previous to the first time; and adjusting means for adjusting a degree of the changing by the change means with reference to the result of the comparison stored in the comparison result memory means.

96. The display as set forth in claim 95, further comprising a liquid crystal display element of vertical alignment mode and normally black mode.

97. A drive signal processor for processing a display drive signal, comprising:

memory means for storing data of a drive signal input at a first time;

change means for changing a voltage level of a drive signal input at a second time, subsequent to the first time, based upon the stored data so as to accelerate a tone transition from the first time to the second time;

comparison result memory means for storing a result of a comparison of the stored data corresponding to the drive signal input at the first time and data input at a time previous to the first time; and adjusting means for adjusting a degree of the changing by the change means with reference to the result of the comparison stored in the comparison result memory means.

98. A computer-readable storage medium, on which is recorded a program adapted to cause a computer to execute the steps of:

storing data corresponding to a drive signal input at a first time;

changing a voltage level of a drive signal input at a second time, subsequent to the first time, based upon the stored data so as to accelerate a tone transition from the first time to the second time;

comparing data corresponding to the drive signal input at the first time and data input at a time previous to the first time, wherein a degree of the change is adjusted prior to changing, with reference to the result of the comparison.

99. A display, comprising:

a first storage for storing data corresponding to a drive signal input at a first time;

a changer for changing a voltage level of a drive signal input at a second time, subsequent to the first time, based upon the stored data so as to accelerate a tone transition from the first time to the second time;

a second storage for storing a result of a comparison of the stored data corresponding to the drive signal input at the first time and data input at a time previous to the first time; and an adjuster for adjusting a degree of the changing by the changer with reference to the result of the comparison stored in the second storage.

100. A method of driving a display, comprising:

determining a display drive signal based on desired drive signal data and current corresponding drive signal data; and driving the display with a selected one of the determined display drive signal and a variation of the determined display drive signal, selected based upon at least a previous corresponding drive signal data and the current drive signal data.

101. The method of driving a display of claim 100, wherein the current corresponding drive signal data includes data from a drive signal input at a first time, the desired drive signal data includes data from a drive signal input at a second time, subsequent to the first time, and the previous corresponding drive signal data includes data from a drive signal input at a time previous to the first time.

102. The method of driving a display as set forth in claim 101, wherein when it is determined, on the basis of the drive signal input at the first time and the drive signal input at the second time, that a tone transition from the first time to the second time is insufficient, a degree of the variation is reduced.

103. The method of driving a display as set forth in claim 102, wherein flag information is stored when the determination is made, instructing a process which reduces the degree of the variation.

104. The method of driving a display as set forth in claim 101, wherein when a level of the second drive signal input at the second time is lower than a level of the first drive signal input at the first time, a condition is met and a degree of variation is reduced.

105. The method of driving a display as set forth in claim 104, wherein flag information is stored when the condition is met, instructing a process which reduces the degree of variation.

106. The method of driving a display as set forth in claim 101, wherein when a level of the second drive signal input at the second time is lower than a level of the first drive signal input at the first time and when the level of the second drive signal input at the second time is at most equal to a predetermined value, a condition is met and a degree of variation is reduced.

107. The method of driving a display as set forth in claim 106, wherein flag information is stored when the condition is met, instructing a process which reduces the degree of variation.

108. The method of driving a display as set forth in claim 101, wherein when a level of the second drive signal input at the second time is lower than a level of the first drive signal input at the first time and when a difference between the level of the first drive signal and the level of the second drive signal is at least equal to a predetermined value, a condition is met and a degree of variation is reduced.

109. The method of driving a display as set forth in claim 108, wherein flag information is stored when the condition is met, instructing a process which reduces the degree of variation.

110. The method of driving a display as set forth in claim 101, wherein when a level of the second drive signal input at the second time is lower than a level of the first drive signal input at the first time and when a difference between the level of the first drive signal and the level of the second drive signal is at least equal to a mean brightness level over at least a part of a displayed image, multiplied by a substantially constant value, a condition is met and a degree of variation is reduced.

111. The method of driving a display as set forth in claim 110, wherein flag information is stored when the condition is met, instructing a process which reduces the degree of variation.

112. The method of driving a display as set forth in claim 101, wherein when a level of the second drive signal input at the second time is lower than a level of the first drive signal input at the first time and when a difference between the level of the second drive signal and the level of the first drive signal multiplied by a predetermined coefficient is at least equal to a predetermined level, a condition is met and a degree of variation is reduced.

113. The method of driving a display as set forth in claim 112, wherein flag information is stored when the condition is met, instructing a process which reduces the degree of variation.

114. A computer-readable storage medium, on which is recorded a program adapted to cause a computer to execute the method of claim 100.

115. A display, comprising:

means for determining a display drive signal based on desired drive signal data and current corresponding drive signal data; and means for driving the display with a selected one of the determined display drive signal and a variation of the determined display drive signal, selected based upon at least a previous corresponding drive signal data and the current drive signal data.

116. The display of claim 115, further comprising memory means for storing the desired drive signal data and current corresponding drive signal data.

117. The display of claim 116, further comprising comparison result memory means for storing a result of a comparison of at least a previous corresponding drive signal data and the current drive signal data.

118. The display of claim 117, further comprising adjusting means for adjusting a degree of the variation with reference to the result of the comparison stored in the comparison result memory means.

119. The display of claim 115, wherein the current corresponding drive signal data includes data from a drive signal input at a first time, the desired drive signal data includes data from a drive signal input at a second time, subsequent to the first time, and the previous corresponding drive signal data includes data from a drive signal input at a time previous to the first time.

120. The display as set forth in claim 115, further comprising a liquid crystal display element of vertical alignment mode and normally black mode.

121. A drive signal processor for processing a display drive signal, comprising:

means for determining a display drive signal based on desired drive signal data and current corresponding drive signal data; and means for driving the display with a selected one of the determined display drive signal and a variation of the determined display drive signal, selected based upon at least a previous corresponding drive signal data and the current drive signal data.

122. The drive signal processor of claim 121, further comprising memory means for storing the desired drive signal data and current corresponding drive signal data.

123. The drive signal processor of claim 122, further comprising comparison result memory means for storing a result of a comparison of at least a previous corresponding drive signal data and the current drive signal data.

124. The drive signal processor of claim 123, further comprising adjusting means for adjusting a degree of the variation with reference to the result of the comparison stored in the comparison result memory means.

125. The drive signal processor of claim 121, wherein the current corresponding drive signal data includes data from a drive signal input at a first time, the desired drive signal data includes data from a drive signal input at a second time, subsequent to the first time, and the previous corresponding drive signal data includes data from a drive signal input at a time previous to the first time.

126. The drive signal processor as set forth in claim 121, further comprising a liquid crystal display element of vertical alignment mode and normally black mode.

127. A display, comprising:

a processor, adapted to determine a display drive signal based on desired drive signal data and current corresponding drive signal data; and a selector, adapted to select a drive signal for driving the display from one of the determined display drive signal and a variation of the determined display drive signal, the selection being based upon at least a previous corresponding drive signal data and the current drive signal data.

128. The display of claim 127, further comprising:

a second processor, coupled to the selector, adapted to create the variation of the determined drive signal.

129. The display of claim 127, further comprising a memory, coupled to the processor, for storing the current corresponding drive signal data.

130. The display of claim 127, wherein the current corresponding drive signal data includes data from a drive signal input at a first time, the desired drive signal data includes data from a drive signal input at a second time, subsequent to the first time, and the previous corresponding drive signal data includes data from a drive signal input at a time previous to the first time.

* * * * *